US008737668B1

(12) United States Patent
Blair et al.

(10) Patent No.: US 8,737,668 B1
(45) Date of Patent: May 27, 2014

(54) HEADBAND FOR PERSONAL SPEAKERS

(71) Applicant: Koss Corporation, Milwaukee, WI (US)

(72) Inventors: Nick S. Blair, Whitefish Bay, WI (US); Stephen Fiacchino, Port Washington, WI (US); Michael J. Koss, Milwaukee, WI (US); Michael J. Koss, Jr., Milwaukee, WI (US)

(73) Assignee: Koss Corporation, Milwaukee, WI (US)

( * ) Notice: Subject to any disclaimer, the term of this patent is extended or adjusted under 35 U.S.C. 154(b) by 0 days.

(21) Appl. No.: 13/747,549

(22) Filed: Jan. 23, 2013

(51) Int. Cl.
*H04R 25/00* (2006.01)

(52) U.S. Cl.
USPC ..... 381/378; 381/395; 381/379

(58) Field of Classification Search
USPC ..... 381/182, 183, 186, 309, 370, 371, 374, 381/378, 379, 383, 384, 386, 393, 394, 395
See application file for complete search history.

(56) References Cited

U.S. PATENT DOCUMENTS

| | | | | |
|---|---|---|---|---|
| 1,835,575 | A | 12/1931 | Sanders et al. | |
| 2,819,105 | A | 1/1958 | Behnke | |
| 3,287,760 | A | 11/1966 | Moore | |
| 3,787,899 | A | 1/1974 | Krawagna | |
| 3,909,077 | A | 9/1975 | Leonarduzzi | |
| 4,588,868 | A | 5/1986 | Bertagna et al. | |
| 5,035,005 | A * | 7/1991 | Hung | 2/209 |
| 5,290,120 | A | 3/1994 | Osterfeld et al. | |
| 5,384,857 | A | 1/1995 | Nordin et al. | |
| 5,406,037 | A * | 4/1995 | Nageno et al. | 181/129 |
| 5,793,878 | A * | 8/1998 | Chang | 381/370 |
| 5,862,241 | A * | 1/1999 | Nelson | 381/379 |
| 6,333,982 | B1 | 12/2001 | Sapiejewski et al. | |
| 6,542,615 | B1 * | 4/2003 | Ito | 381/374 |
| 6,549,789 | B1 | 4/2003 | Kfoury | |
| 6,630,878 | B2 | 10/2003 | Pan et al. | |
| 6,715,315 | B1 | 4/2004 | Hartgrove | |
| 6,754,361 | B1 * | 6/2004 | Hall et al. | 381/370 |
| 6,772,853 | B2 * | 8/2004 | Yang | 181/129 |
| 6,929,076 | B2 * | 8/2005 | Fanuel et al. | 175/267 |
| D514,087 | S | 1/2006 | Wilson et al. | |
| 6,993,143 | B2 * | 1/2006 | Harris et al. | 381/379 |
| 7,171,698 | B2 | 2/2007 | Saffran | |
| 7,337,497 | B2 | 3/2008 | Seidler et al. | |
| 7,451,523 | B2 | 11/2008 | Chen | |
| 7,647,020 | B2 | 1/2010 | Chuang | |

(Continued)

FOREIGN PATENT DOCUMENTS

| | | | |
|---|---|---|---|
| JP | 2006-112523 | A1 | 4/2006 |
| WO | WO 2011/137034 | A1 | 11/2011 |

*Primary Examiner* — Davetta W Goins
*Assistant Examiner* — Phylesha Dabney
(74) *Attorney, Agent, or Firm* — K&L Gates LLP

(57) ABSTRACT

An assembly for holding a personal speaker relative to a user's ear. A headband assembly can include a band, a sleeve attached to an end of the band, and an arm moveably secured to the sleeve. The sleeve can include a pair of laterally opposed detent channels, and the arm can include a pair of spring-loaded bearings. Each spring-loaded bearing can engage one of the laterally opposed detent channels. The headband assembly can be adjusted by moving the arm relative to the sleeve. An arm of the headband assembly can be pivotally secured to a yoke by a magnetic pivot arrangement. The magnetic pivot arrangement can include a groove, a protrusion, and magnetic elements. A yoke can be pivotally secured to a housing by housing pivot arrangement. The housing pivot arrangement can include a pin extending from the yoke and a collar retained in the housing.

20 Claims, 37 Drawing Sheets

(56) References Cited

U.S. PATENT DOCUMENTS

| | | | | |
|---|---|---|---|---|
| 7,885,419 | B2 * | 2/2011 | Wahl et al. | 381/74 |
| 7,915,986 | B2 | 3/2011 | Lu | |
| 7,934,291 | B2 | 5/2011 | Prest | |
| 7,941,191 | B2 | 5/2011 | Hanssen et al. | |
| D639,775 | S | 6/2011 | Horibe et al. | |
| 8,015,666 | B2 | 9/2011 | Wang | |
| 8,050,444 | B2 * | 11/2011 | Smith | 381/379 |
| 8,055,006 | B2 | 11/2011 | Santiago | |
| 8,159,834 | B2 | 4/2012 | Griffin et al. | |
| 8,213,662 | B2 * | 7/2012 | Ishida | 381/371 |
| 8,213,667 | B2 | 7/2012 | Nelson et al. | |
| 8,233,655 | B2 | 7/2012 | Miyata | |
| 8,270,658 | B2 * | 9/2012 | Goldberg et al. | 381/384 |
| 8,313,492 | B2 * | 11/2012 | Wong et al. | 606/96 |
| 8,325,962 | B2 * | 12/2012 | Ishida et al. | 381/370 |
| 8,371,417 | B2 * | 2/2013 | Miyazawa | 181/129 |
| 8,424,470 | B2 * | 4/2013 | Volin | 108/118 |
| 8,559,665 | B2 * | 10/2013 | Schmidt et al. | 381/374 |
| 8,605,935 | B1 * | 12/2013 | Huang | 381/381 |
| 2005/0053255 | A1 * | 3/2005 | Harris et al. | 381/379 |
| 2005/0238189 | A1 * | 10/2005 | Tsai | 381/309 |
| 2006/0256992 | A1 * | 11/2006 | Liao | 381/371 |
| 2008/0175406 | A1 * | 7/2008 | Smith | 381/87 |
| 2009/0061961 | A1 | 3/2009 | Ueta | |
| 2009/0257817 | A1 | 10/2009 | Chu | |
| 2009/0268936 | A1 * | 10/2009 | Goldberg et al. | 381/384 |
| 2010/0034414 | A1 * | 2/2010 | Miyata | 381/374 |
| 2010/0046782 | A1 * | 2/2010 | Ito et al. | 381/378 |
| 2010/0205773 | A1 | 8/2010 | Kim | |
| 2011/0051976 | A1 | 3/2011 | Tsai | |
| 2011/0103635 | A1 * | 5/2011 | Asakura et al. | 381/378 |
| 2011/0116672 | A1 * | 5/2011 | Wahl et al. | 381/375 |
| 2011/0116674 | A1 * | 5/2011 | Asakura et al. | 381/378 |
| 2011/0194721 | A1 * | 8/2011 | Schmidt et al. | 381/370 |
| 2012/0140973 | A1 | 6/2012 | Olodort et al. | |
| 2013/0003984 | A1 * | 1/2013 | Belafonte et al. | 381/74 |
| 2013/0083955 | A1 * | 4/2013 | Miyazawa | 381/378 |
| 2013/0136293 | A1 * | 5/2013 | Lee et al. | 381/378 |
| 2013/0156247 | A1 * | 6/2013 | Boyajian et al. | 381/370 |
| 2013/0195307 | A1 * | 8/2013 | Mizuno et al. | 381/374 |
| 2013/0195308 | A1 * | 8/2013 | Tankersley et al. | 381/378 |

* cited by examiner

HEADBAND FOR PERSONAL SPEAKERS

CROSS-REFERENCE TO RELATED APPLICATIONS

The Applicant of the present application also owns the U.S. patent applications identified below which were filed on even date herewith and which are each herein incorporated by reference in their respective entirety:

U.S. patent application Ser. No. 13/747,547, entitled "Headband for Personal Speakers"; and U.S. patent application Ser. No. 13/747,551, entitled "Headband for Personal Speakers".

BACKGROUND

A headband may be used with personal speakers. The headband may be positioned relative to a user's head and/or neck to hold the personal speakers relative to the user's ears. For example, the headband can hold the personal speakers in, over, and/or around the user's ears. Due to variations in the shape and size of peoples' heads, as well as variations in personal preferences regarding the positioning and fit of headphones, it is often difficult to design a rugged headband that is comfortable for large masses of people.

SUMMARY

An aspect of the present disclosure is directed to a headband assembly for holding a personal speaker relative to a user's ear, the headband assembly can comprise a spring band, a sleeve in which is disposed a first end portion of the spring band, and an arm. The sleeve can comprise a first plurality of detent pockets and a second plurality of detent pockets positioned laterally relative to the first plurality of detent pockets. The arm can comprise a first spring-loaded bearing that adjustably engages the first plurality of detent pockets, and a second spring-loaded bearing that adjustably engages the second plurality of detent pockets. The first and second spring-loaded bearings can adjustably secure the arm to the sleeve when the first spring-loaded bearing engages one pocket of the first plurality of detent pockets and the second spring-loaded bearing engages one pocket of the second plurality of detent pockets.

In another aspect of the present disclosure, a headband assembly can comprise a band, a first sleeve attached to an end portion of the band, and a first extension moveably secured to the first sleeve. The first sleeve can comprise a pair of laterally opposed detent channels. The first extension can comprise a pair of spring-loaded bearings, wherein each spring-loaded bearing engages one of the pair of laterally opposed detent channels.

In another aspect of the present disclosure, an assembly can comprise an extension arm, an attachment element, and a spring member secured to the attachment element. The extension arm can comprise a first detent bearing and a second detent bearing. The attachment element can comprise a first row of detent pockets that receives the first detent bearing, and a second row of detent pockets that receives the second detent bearing. The first row of detent pockets can laterally oppose the second row of detent pockets, and the extension arm can be movably positioned relative to the attachment element.

In an aspect of the present disclosure, a headband assembly for holding a personal speaker relative to a user's ear can comprise a band, and a yoke configured to support the personal speaker. The band can comprise a band body, a groove, and a first band magnetic element. The band body can comprise a first surface and the groove can extend from the first surface into the band body. The yoke can comprise a yoke body, comprising a second surface, wherein the second surface is positioned relative to the first surface. The yoke can further comprise a protrusion extending from the second surface into the groove of the band, and a first yoke magnetic element. The yoke can be configured to pivot between a first position and at least one second position relative to the band. Further, a magnetic pole of the first band magnetic element can be aligned with a magnetic pole of the first yoke magnetic element when the yoke is in the first position, and a magnetic attraction between the first band magnetic element and the first yoke magnetic element can pull the magnetic poles of the first yoke magnetic element and the first band magnetic element toward alignment when the yoke is in the second position.

In another aspect of the present disclosure, a headband assembly can comprise a band, and a yoke configured to support a personal speaker. The band can comprise a band body, a groove, and a first pair of magnetic elements. The band body can comprise a first surface, and the groove can extend from the first surface into the band body. The yoke can comprise a yoke body, a protrusion, and a second pair of magnetic elements. The yoke body can comprise a second surface, and the protrusion can extend from the second surface into the groove of the band. The yoke can be configured to pivot between a neutral position and pivoted positions relative to the band, wherein the first and second pairs of magnetic elements can interact to generate a magnetic force, and wherein the magnetic force forces the yoke toward the neutral position when the yoke is in one of the pivoted positions.

In an aspect of the present disclosure, an earpiece for holding a personal speaker can comprise a housing configured to hold the personal speaker, a yoke pivotally secured to the housing. The housing can comprise a collar, which can comprise an arm comprising an arm surface, a stop comprising a stop surface, and an opening between the arm surface and the stop surface. The stop surface can be angularly oriented relative to the arm surface. The yoke can comprise a pin configured to engage the housing, wherein the pin can comprise a head, wherein the head can be configured to extend into the opening in the collar, and wherein the head can be configured to pivot between the arm surface and the stop surface.

In an aspect of the present disclosure, an earpiece assembly can comprise a housing configured to hold a personal speaker, a collar fixed to the housing, a yoke, wherein the housing is configured to pivot relative to the yoke, and a pin fixed to the yoke. The collar can comprise a flexible arm and a stop. The flexible arm can comprise an arm surface, and the stop can comprise a stop surface. The stop surface can be angularly oriented relative to the arm surface. The pin can extend from the yoke to between the flexible arm and the stop of the collar, and the pin can be configured to deform the flexible arm as the pin pivots from the arm surface toward the stop surface of the collar.

BRIEF DESCRIPTION OF THE FIGURES

Various embodiments of the present invention are described herein by way of example in conjunction with the following Figures, wherein.

DETAILED DESCRIPTION

Figure 1:
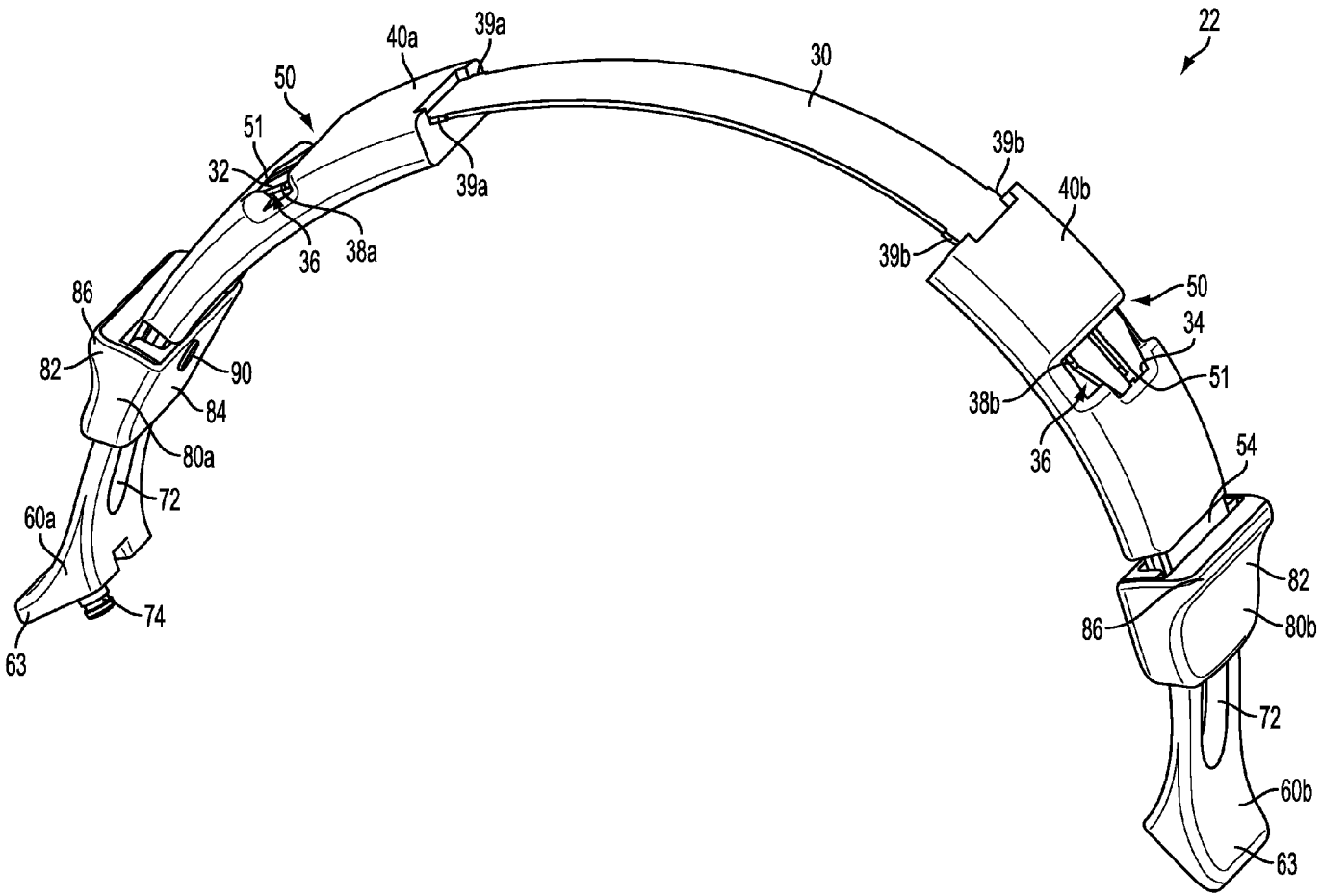
FIG. 1 is a perspective view of a headband assembly according to various embodiments of the present disclosure.
Figure 2:
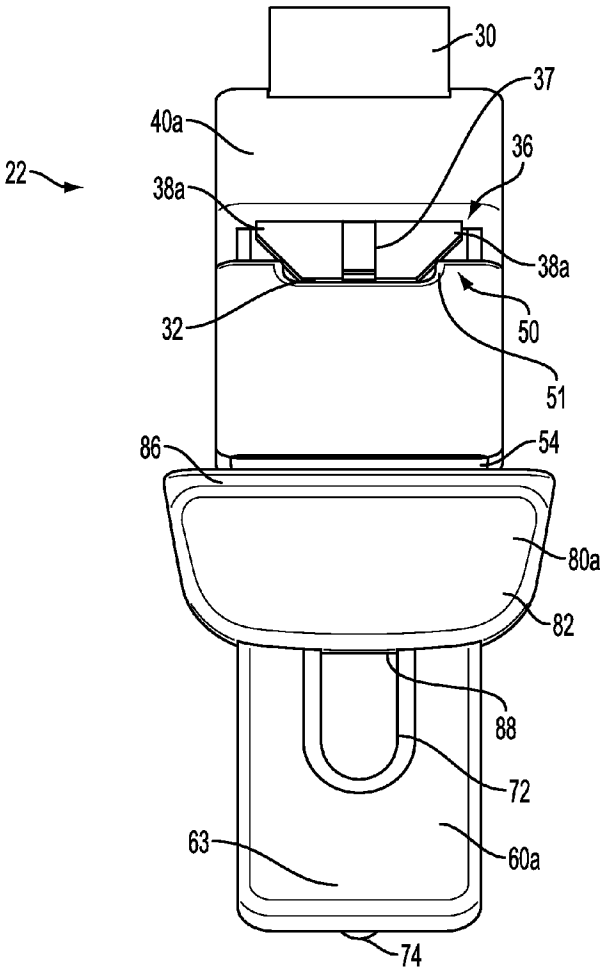
FIG. 2 is an elevational view of the headband assembly of FIG. 1 according to various embodiments of the present disclosure.
Figure 3:
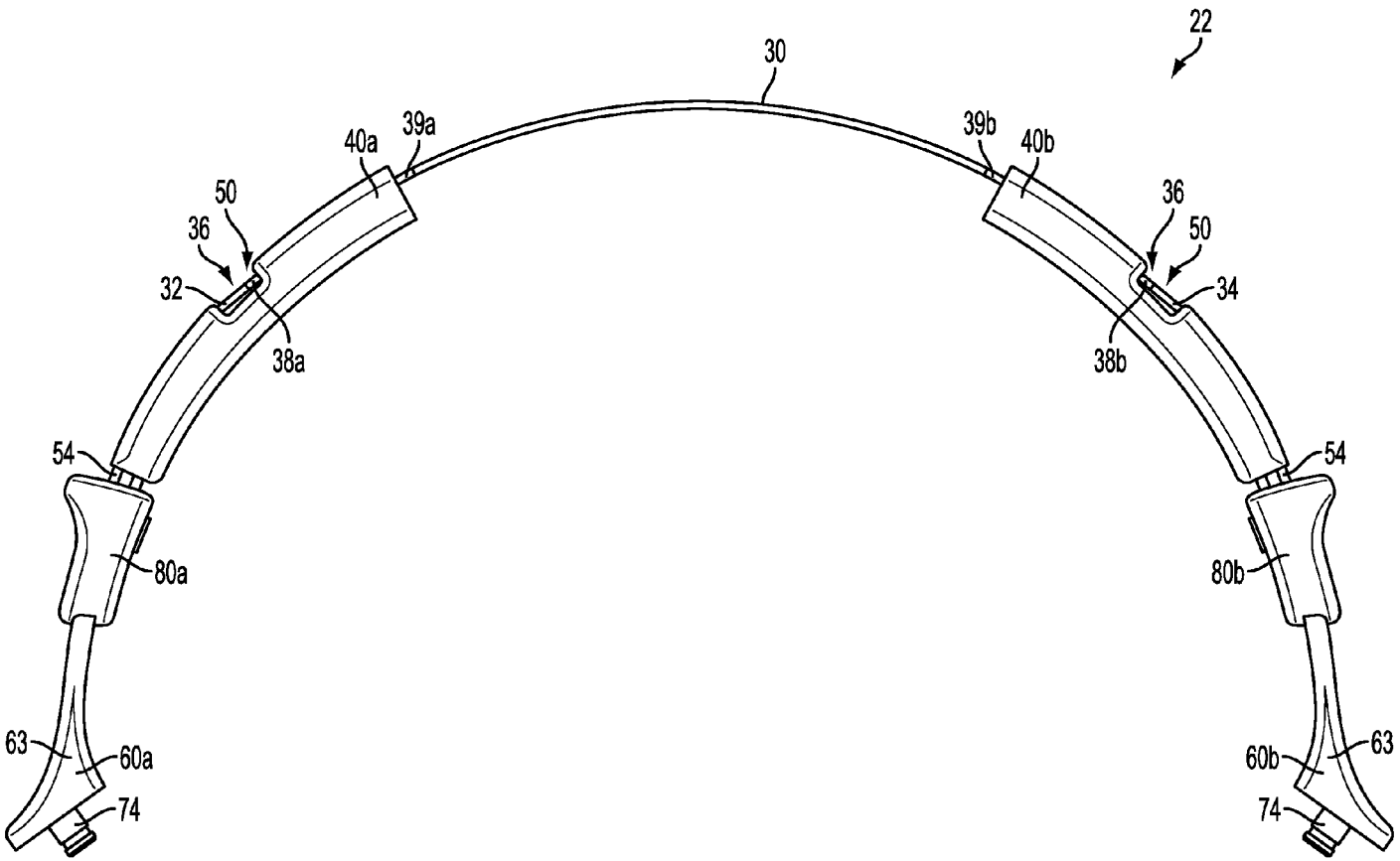
FIG. 3 is another elevational view of the headband assembly of FIG. 1 according to various embodiments of the present disclosure.

According to various embodiments, the present invention is directed to a headband assembly that can be used with personal speakers and worn, for example, on the head of a human user. Referring primarily to FIGS. 1-3, a headband assembly 22 can include a spring band 30, a sleeve or attachment portion 40*a*, and an extension arm 60*a*. As described herein, the sleeve 40*a* can be attached to an end of the spring band 30, and the extension arm 60*a* can be moveably secured to a sleeve 40*a*. In various embodiments, the headband assembly 22 can include a single spring band 30, two sleeves 40*a*, 40*b*, and two extension arms 60*a*, 60*b*, for example. The first sleeve 40*a* can be attached to a first end 32 of the spring band 30 and the second sleeve 40*b* can be attached to a second end 34 of the spring band. Furthermore, the first extension arm 60*a* can be moveably secured to the first sleeve 40*a* and the second extension arm 60*b* can be moveably secured to the second sleeve 40*b*. A component on a first side of the headband assembly may have a corresponding or identical component on a second side of the headband assembly 22. In other words, the components of the headband assembly 22 can be modular. For example, the first sleeve 40*a* can be interchangeable with the second sleeve 40*b* and the first arm 60*a* can be interchangeable with the second arm 60*b*. Accordingly, throughout this Detailed Description, elements and/or characteristics of a component on a first side or a second side of the headband assembly 22 may be described and, unless otherwise indicated, such description is intended to apply to the corresponding or identical component on the other side of the headband assembly 22, as well.

In various embodiments, the headband assembly 22 can be positioned relative to a user's head and/or neck. For example, the headband assembly 22 can fit around the top and/or the crown of a user's head, and/or around the back and/or nape of a user's neck. A pair of personal speakers, such as earphones 100*a*, 100*b* (FIGS. 21 & 22) may be attached to the headband assembly 22. The headband assembly 22 can hold the earphones 100*a*, 100*b* relative to the user's head and/or neck, and specifically relative to the user's ears such that the earphones 100*a*, 100*b* are in, over, and/or around the user's ears, for example. The headband assembly 22 can be adapted for use with various sizes and styles of earphones 100*a*, 100*b*, for example.

Figure 4:
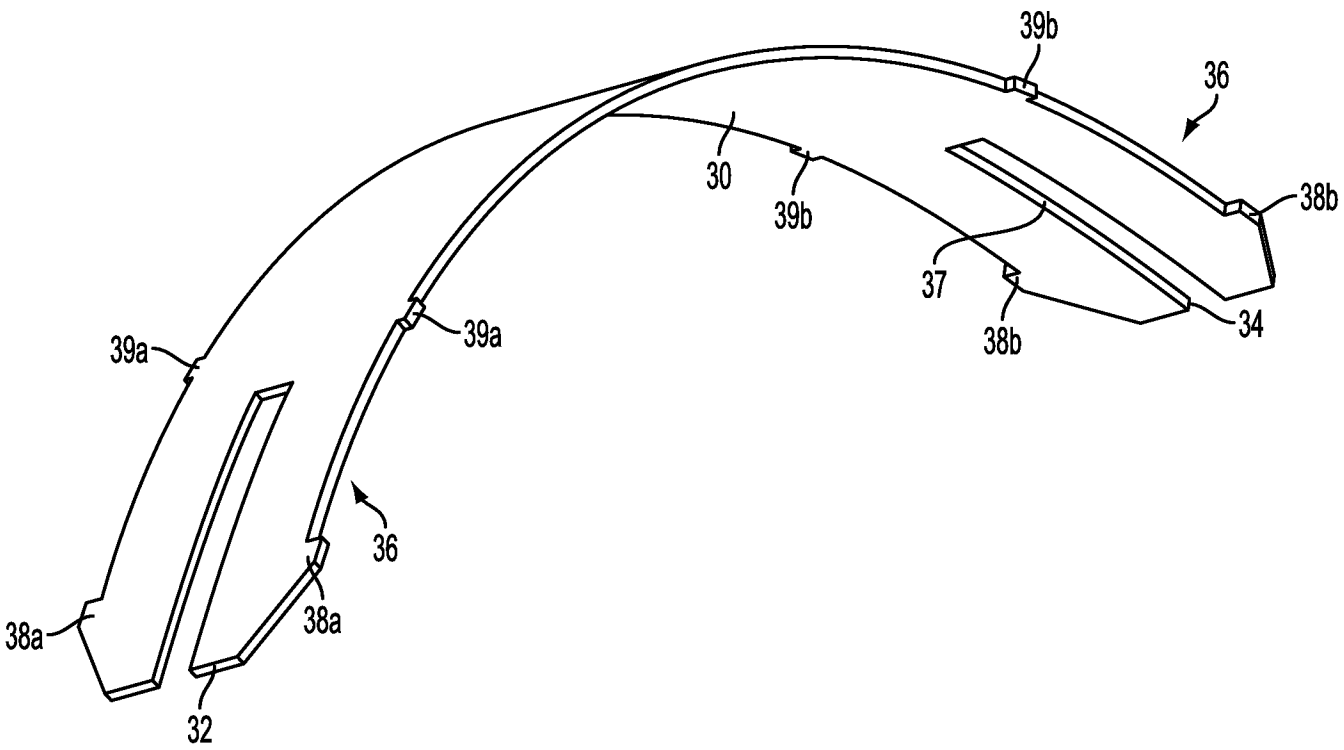
FIG. 4 is a perspective view of a spring band of the headband assembly of FIG. 1 according to various embodiments of the present disclosure.
Figure 5:
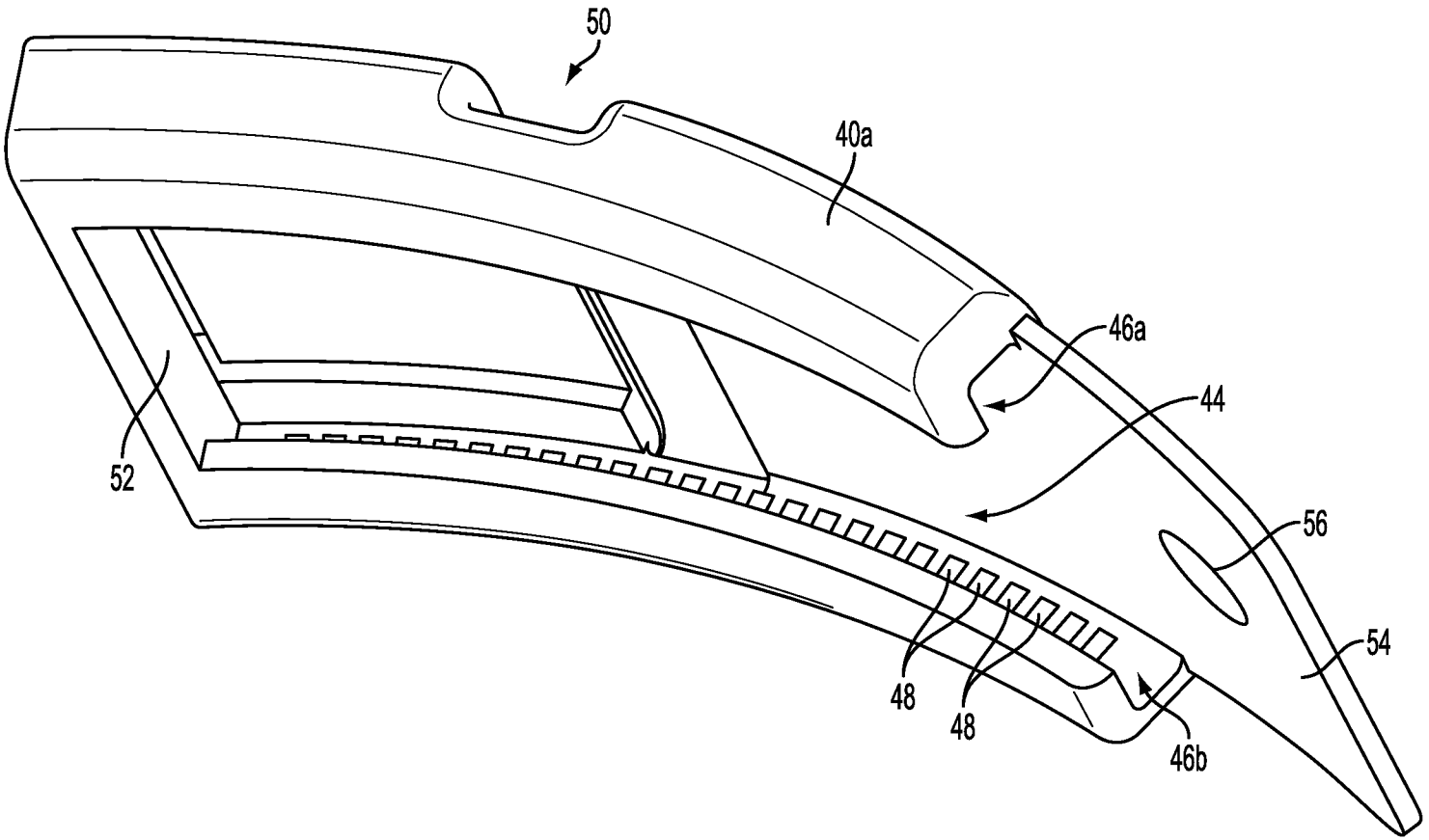
FIG. 5 is a perspective view of a sleeve of the headband assembly of FIG. 1 according to various embodiments of the present disclosure.

Referring now to FIG. 4, the spring band 30 can be contoured or arced. Furthermore, the spring band 30 can have a spring constant such that the deformation of the spring band 30 from an initial configuration to a deformed configuration can result in a springback or restoring force. In various embodiments, the spring band 30 can be deformed from the initial configuration to the deformed configuration when the spring band 30 is positioned relative to the user's head and/or neck. For example, the spring band 30 can be deformed to a less contoured or less arced configuration when positioned relative to the user's head and/or neck. Consequently, the spring band 30 can exert a springback force on the user's head and/or neck as the spring band 30 seeks to return or to substantially return to its initial configuration. Such a springback force can help to secure the spring band 30, and ultimately the entire headband assembly 22, in place relative to the user's head and/or neck. Furthermore, in some embodiments, the spring band can generate a springback or restoring force of approximately 1.25 lb when positioned relative to the user's head and/or neck. In at least one embodiment, the spring band 30 can generate a springback or restoring force of approximately 0.75 lb to approximately 2.0 lb when positioned relative to the user's head and/or neck.

The spring constant of the spring band 30 can at least depend on the dimensions and material thereof. In at least one embodiment, the spring band 30 can be approximately 5.3 inches by approximately 0.75 inches by approximately 0.03 inches with an initial, undeformed radius of curvature of approximately 3.3 inches. In various embodiments, the dimensions of the spring band 30, including the radius of curvature, can be selected such that the spring band 30 comfortably fits the user's head and/or neck. Additionally, the dimensions of the spring band 30 can be selected such that the spring band 30 smoothly interfaces with the other headband assembly 22 components such as the sleeve 40*a*, for example. In at least one embodiment, the spring band 30 can comprise stainless steel, for example. In various embodiments, the spring band 30 can comprise metallic and/or polymeric materials, for example, such as nylon and/or acrylonitrile butadiene styrene (ABS), for example.

Referring still to FIG. 4, the spring band 30 can include the first distal end 32 and the second distal end 34. As described herein, the first distal end 32 and/or the second distal end 34 of the spring band 30 can be positioned in and/or disposed through a portion of one of the sleeves 40*a*, 40*b* such that the sleeve 40*a*, 40*b* is attached to the spring band 30 at or near the respective distal end 32, 34 thereof. The spring band 30 can include a pronged portion 36 extending from a distal end 32, 34 along a portion of the spring band 36. Still referring to FIG. 4, the spring band 30 can include the pronged portion 36 extending from the first distal end 32 and the pronged portion 36 extending from the second distal end 34. The pronged portion 36 can be defined by a slot 37 that extends from the respective distal end 32, 34 through a portion of the spring band 30, such as 1.0 inch or 20% of the length of the spring band 30, for example. The pronged portion 36 can taper as the pronged portion 36 approaches the respective distal end 32, 34, for example. In various embodiments, the pronged portion 36 can be deformable. For example, the prongs of the pronged portion 36 can move towards each other and the width of the slot can be reduced to compress or narrow the width of the pronged portion 36 of the spring band 30. When the pronged portion 36 is deformed, the spring band 30 can exert a springback or restoring force as it seeks to return or substantially return to its initial configuration. As described herein, such a springback force generated by the pronged portion 36 can help to secure the spring band 30 to the sleeve 40*a*, 40*b* positioned relative thereto. In various embodiments, the spring band 30 can include additional slots and/or prongs, for example. In other embodiments, the spring band 30 may not include a slot and/or prongs, but may have other features or geometries that provide springback when a portion of the spring band 30 is deformed or compressed.

Still referring primarily to FIG. 4, the spring band 30 can include tabs 38*a*, 38*b*, 39*a*, 39*b* designed to help secure the spring band 30 to the first sleeve 40*a* and/or the second sleeve 40*b*. In various embodiments, the tabs 38*a*, 38*b*, 39*a*, 39*b* can be laterally opposed tabs. For example, a tab 38*a*, 38*b*, 39*a*, 39*b* can extend from a first lateral side of the spring band 30 in a first direction and a corresponding tab 38*a*, 38*b*, 39*a*, 39*b* can extend from an opposite lateral side of the spring band 30 in a second direction. In some embodiments, the second direction can be substantially opposite to the first direction. Referring still to FIG. 4, the first side of the spring band 30 can include two pairs of opposing tabs 38*a*, 39*a*, for example, and the second side of the spring band 30 can include two additional pairs of opposing tabs 38*b*, 39*b*, for example. A first pair of opposing tabs 38*a* can be positioned near or at the first distal end 32 and/or a second pair of opposing tabs 39*a* can be positioned farther from first distal end 32 such as, for example, past the slot of the pronged portion 36. Furthermore, the spring band 30 can include a third pair of opposing tabs 38*b* near or at the second distal end 34 and/or a fourth pair of opposing tabs 39*b* farther from second distal end 34 such as, for example, past the slot of the pronged portion 36. In other words, the spring band 30 can have two pairs of opposing tabs 38*a*, 39*a* near or around the first distal end 32 and two more pairs of opposing tabs 38*b*, 39*b* near or around the second distal end 34. Further, in various embodiments, the tabs 38*a*, 39*a* on the first side of the spring band 30 can form a mirror image reflection of the tabs 38*b*, 39*b* on the second side of the spring band 30. As described herein, when the sleeve 40*a* is positioned relative to the first end 32 of the spring band 30, the tabs 38*a*, 39*a* of the spring band 30 can engage the sleeve 40*a* to help secure the sleeve 40*a* to the spring band 30.

Referring primarily to FIGS. 5-8, the sleeve or attachment portion 40*a* can have a contoured or arced body that is configured for receiving a portion of the spring band 30. The contour of the sleeve 40*a* can be selected such that the sleeve 40*a* comfortably fits on and/or around a portion of the user's head and/or neck, for example. Furthermore, as described herein, the sleeve 40*a* can be designed to releasably attach to the spring band 30 (FIG. 4) and to adjustably hold and retain the extension arm 60*a* (FIGS. 7 & 12-14). The sleeve 40*a* can include a slot 42 for receiving a portion of the spring band 30 (FIGS. 1-4) therein. The slot 42 can extend through a portion of the sleeve 40*a* to an opening 50. In various embodiments, the opening 50 can include a groove or notch 51 (FIGS. 6 & 8) therein. Referring again to FIGS. 1-3, when the first end 32 of the spring band 30 is positioned relative to the sleeve 40*a*, the first end 32 of the spring band 30 can extend through the slot 42 such that an end portion of the spring band 30 is disposed in the sleeve 40*a*. Further, the groove 51 of the opening 50 can hold the first distal end 32 of the spring band 30. In other embodiments, the first end 32 of the spring band 30 may be held within the slot 42 of the sleeve 40*a*, for example.

In various embodiments, the spring band 30 and the sleeve 40*a* can form a snap-fit connection. For example, referring primarily to FIG. 2, the pronged portion 36 of the spring band 30 can be narrowed or compressed to fit through the slot 42 of the sleeve 40*a*. In various embodiments, the opposing tabs 38*a* nearest the first distal end 32 should also fit through the slot 42 when the pronged portion 36 is narrowed or compressed. When the pronged portion 36 is compressed, the pronged portion 36 can exert a springback force on the sleeve 40*a* in which the pronged portion 36 is retained as the pronged portion 36 seeks to return or substantially return to its undeformed configuration. Opposing tabs 38*a* can be positioned in the opening 50 and can engage the sleeve 40*a* as the pronged portion 36 seeks to return to its undeformed configuration. The springback force can cause the opposing tabs 38*a* that are positioned in the opening 50 to catch the sleeve 40*a*, which can restrict detachment of the sleeve 40*a* from the spring band 30. For example, the opposing tabs 38*a* can catch the sleeve 40*a* such that the pronged portion 36 cannot be withdrawn through the slot 42. Furthermore, the opposing tabs 39*a* that are positioned outside of the sleeve 40*a* (FIGS. 1 & 3) can prevent over-insertion of the spring band 30 into the sleeve 40*a*. For example, the opposing tabs 39*a* can catch the sleeve 40*a* if the first end 32 of the spring band 30 attempts to over-advance through the slot 42. In other words, the opposing tabs 38*a*, 39*a* can releasably lock the spring band 30 in position within the sleeve 40*a* and can prevent unintended retraction and/or over-insertion.

Referring again to FIGS. 1-3, the sleeve 40*a* can releasably attach to the spring band 30. In other words, the sleeve 40*a* may be selectively detached from the spring band 30. For example, the pronged portion 36 of the spring band 30 can be compressed or squeezed to move the prongs inward such that the tabs 38*a* disengage the sleeve 40*a* and permit the pronged portion 36, including the opposing tabs 38*a*, to be withdrawn through the sleeve 40*a*. For example, the pronged portion 36 positioned in the opening 50 can be manually pinched and/or manipulated to release the spring band 30 from the sleeve 40*a*.

Referring again to FIGS. 5, 7-8, the sleeve 40*a* can include an opposing detent arrangement 44. The opposing detent arrangement 44 can include a group of one or more detent pockets 48 on a first internal side of the sleeve 40*a* and an opposing group of one or detent pocket 48 on a second internal side of the sleeve 40*a*. In various embodiments, the opposing detent arrangement 44 can include a first plurality of detent pockets 48 on a first side of the sleeve 40*a* and a second plurality of detent pockets 48 on the second side of the sleeve 40*a*, preferably equal in number to the first plurality of detent pockets. The second plurality of detent pockets 48 can be laterally positioned relative to the first plurality of detent pockets 48, for example. In various embodiments, the first and second pluralities of detent pockets 48 can each be arranged in a row. For example, the sleeve 40*a* can have a pair of laterally opposed channels 46*a*, 46*b* (FIG. 5) on opposing internal side of the sleeve 40*a*. The first channel 46*a* on the first internal side of the sleeve 40*a* can include the first plurality of detent pockets 48 arranged in a row, for example, and the second channel 46*b* on the second internal side of the sleeve 40*a* can include the second plurality of detent pockets 48 arranged in a row, for example. In various embodiments, the first channel 46*a* and the first plurality of detent pockets 48 can form a mirror image reflection of the second channel 46*b* and the second plurality of detent pockets 48. In other embodiments, the channels 46*a*, 46*b* and pluralities of detent pockets 48 on each side of the sleeve 40*a* may be asymmetrical.

Figure 6:
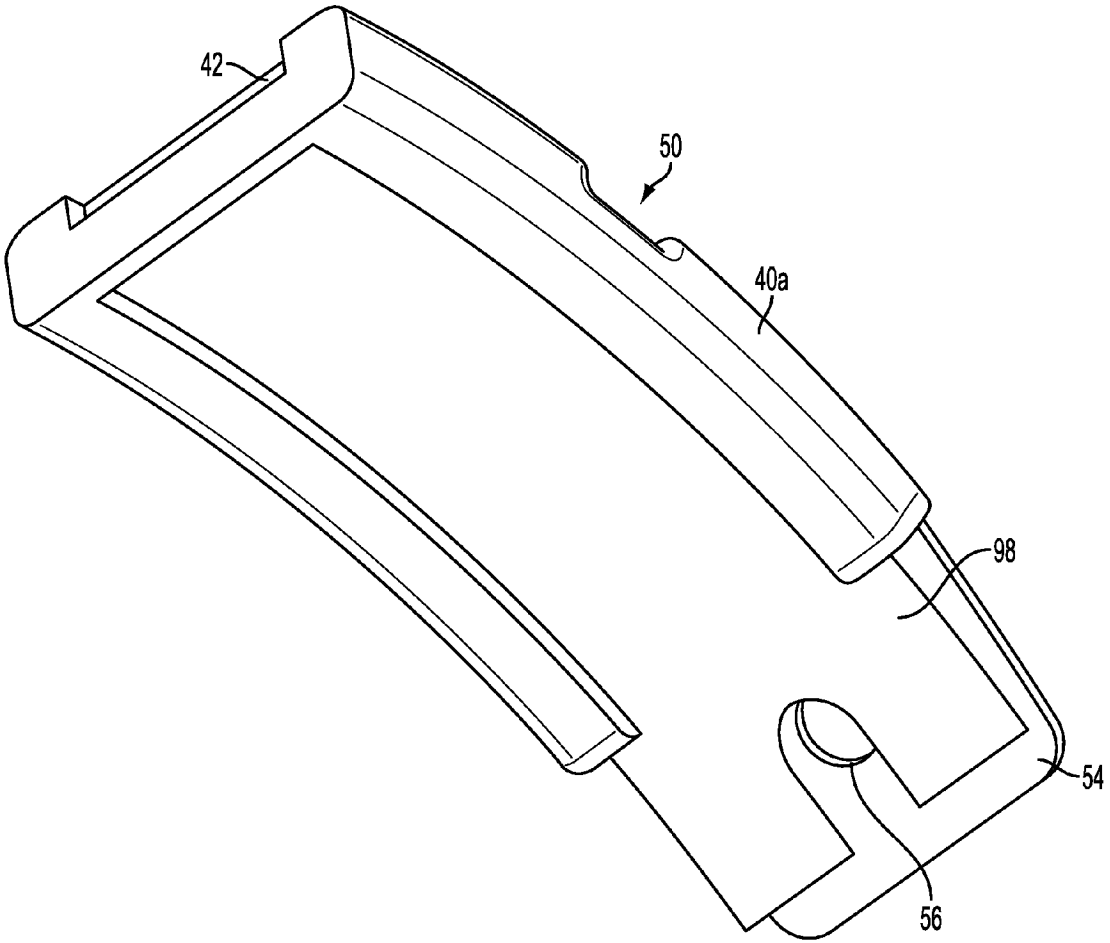
FIG. 6 is a perspective view of the sleeve of FIG. 5 and a liner of the headband assembly of FIG. 1 according to various embodiments of the present disclosure.
Figure 8:
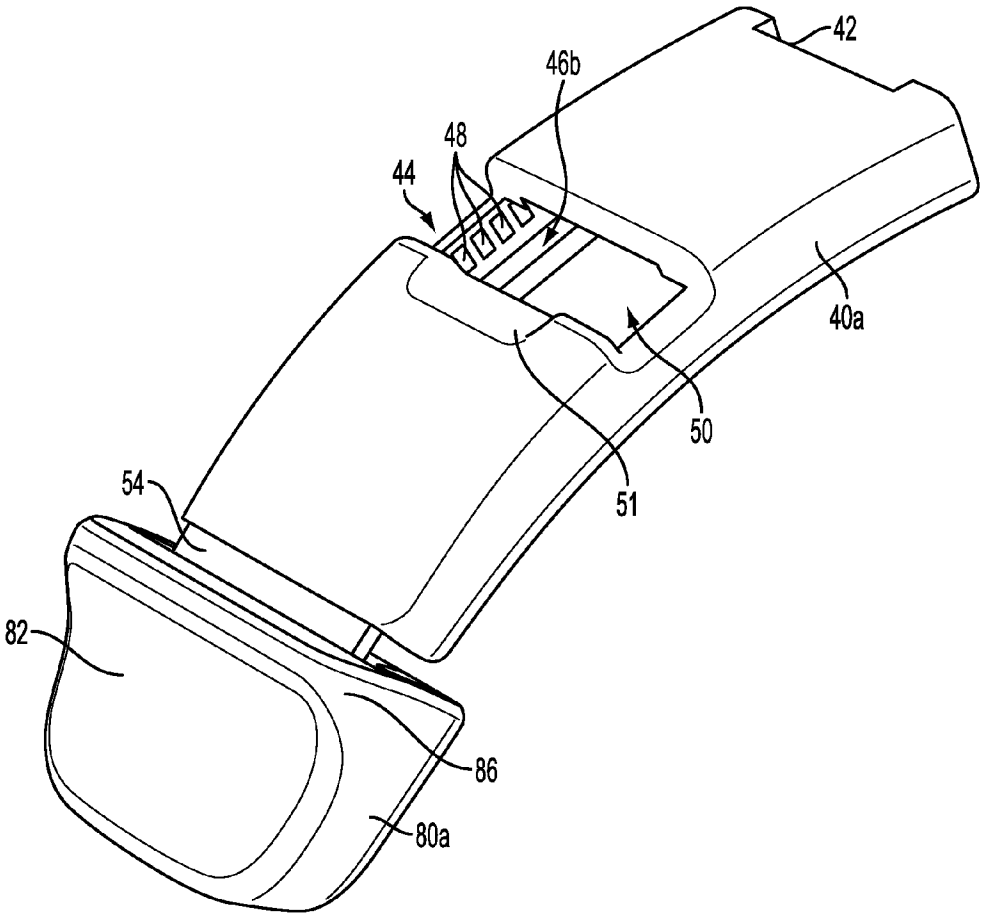
FIG. 8 is a perspective view of the sleeve of FIG. 5 and a cap of the headband assembly of FIG. 1 according to various embodiments of the present disclosure.
Figure 9:
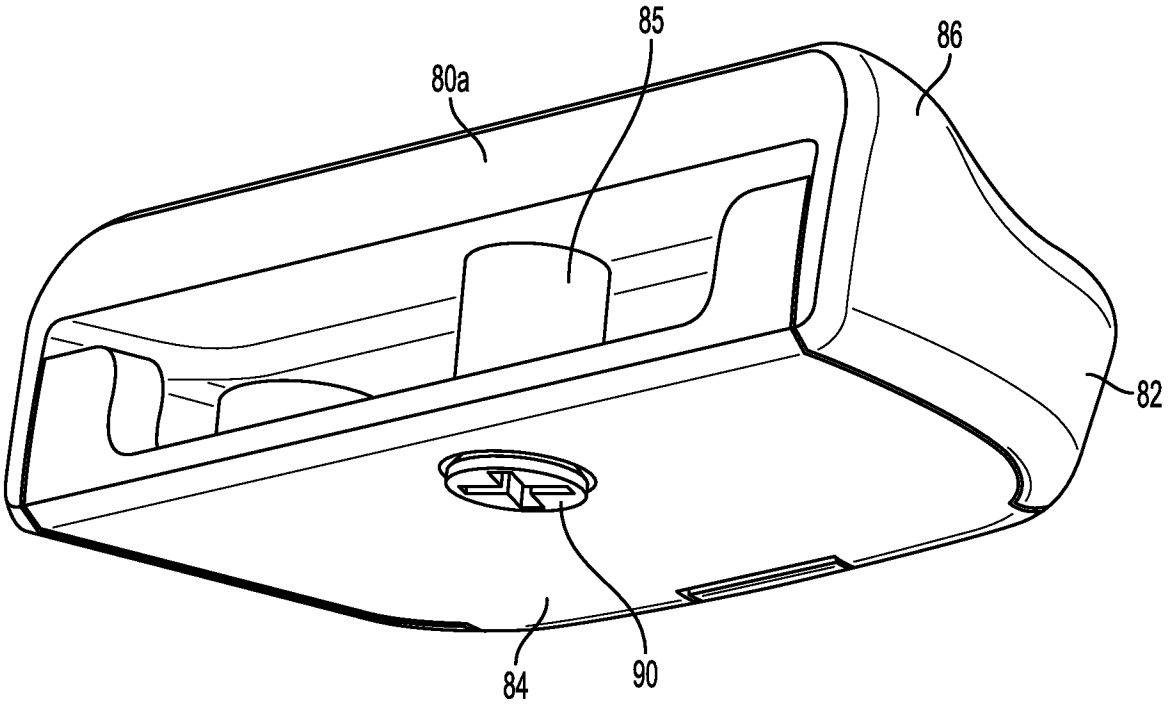
FIG. 9 is a perspective view of the cap of FIG. 8 according to various embodiments of the present disclosure.
Figure 10:
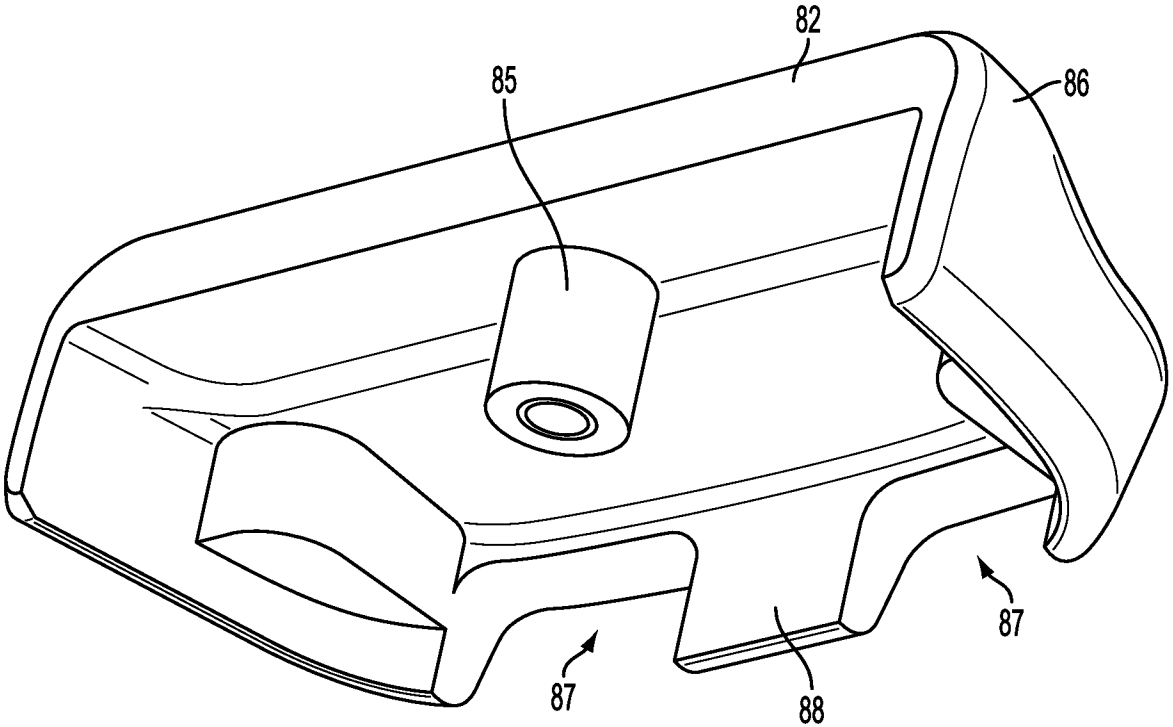
FIG. 10 is a perspective view of a first side of the cap of FIG. 8 according to various embodiments of the present disclosure.
Figure 11:
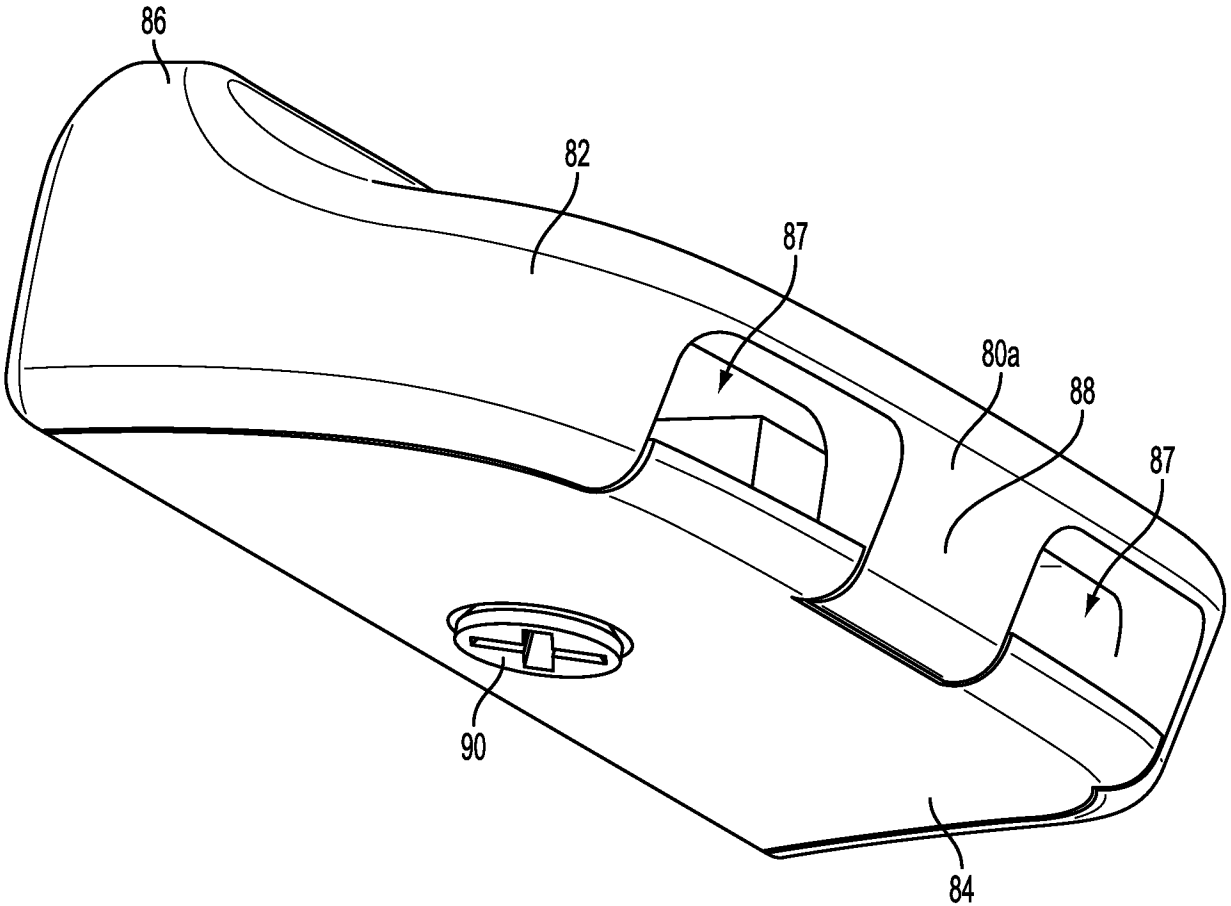
FIG. 11 is another perspective view of the cap of FIG. 8 according to various embodiments of the present disclosure.

Referring again to FIGS. 5-8, the sleeve 40*a* can include a wing 54 that extends from the body of the sleeve 40*a*. The wing 54 can be structured for attachment of the cap 80 (FIG. 8). In various embodiments, the wing 54 can have a hole 56 (FIGS. 5-7) therethrough, which can receive a fastener 90 (FIGS. 9 & 11). As described herein, the fastener 90 can secure the cap 80 to the wing 54 of the sleeve 40*a*. Referring primarily to FIG. 6, the sleeve 40*a* can have a sleeve liner 98, which can be positioned relative to the sleeve 40*a* to enclose or encase the opposing detent arrangement 44 of the sleeve 40*a*. In other words, the opposing detent arrangement 44 can be on an internal surface of the sleeve 40*a*. When the arm 60*a* is positioned relative to the sleeve 40*a*, as described herein, the liner 98 and the sleeve 40*a* can at least partially surround or enclose a portion of the arm 60*a*. In various embodiments, the liner 98 and the sleeve 40*a* can surround the arm 40 such that the arm 60*a* is protected as it moves relative to the sleeve 40*a*.

In at least one embodiment, the sleeve 40*a* can be approximately 2.5 inches by approximately 1.125 inches by approximately 2.25 inches with a radius of curvature of approximately 3.0 inches. In various embodiments, the dimensions of the sleeve 40*a*, including the radius of curvature, can be selected such that the sleeve 40*a* comfortably fits the user's head and/or neck. Additionally, the dimensions of the sleeve 40*a* can be selected such that the sleeve 40*a* smoothly interfaces with the other headband assembly 22 components such as the spring band 30, the arm 60*a* and/or the cap 80, for example. In at least one embodiment, the sleeve 40*a* can comprise nylon and/or acrylonitrile butadiene styrene (ABS) for example. In various embodiments, the sleeve 40*a* can comprise various metallic and/or polymeric materials, for example.

Figure 12:
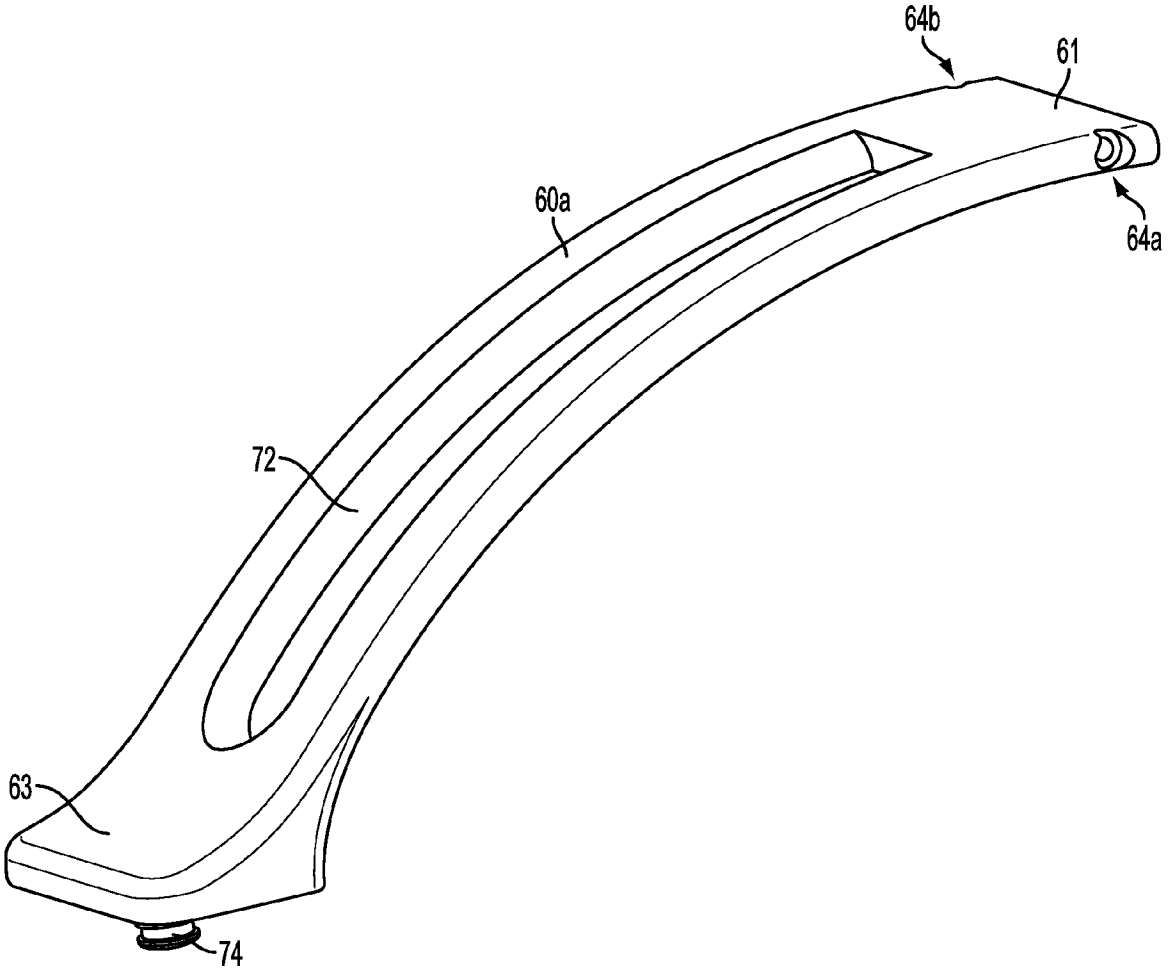
FIG. 12 is a perspective view of the arm of FIG. 7 with the spring-loaded bearings removed therefrom according to various embodiments of the present disclosure.
Figure 13:
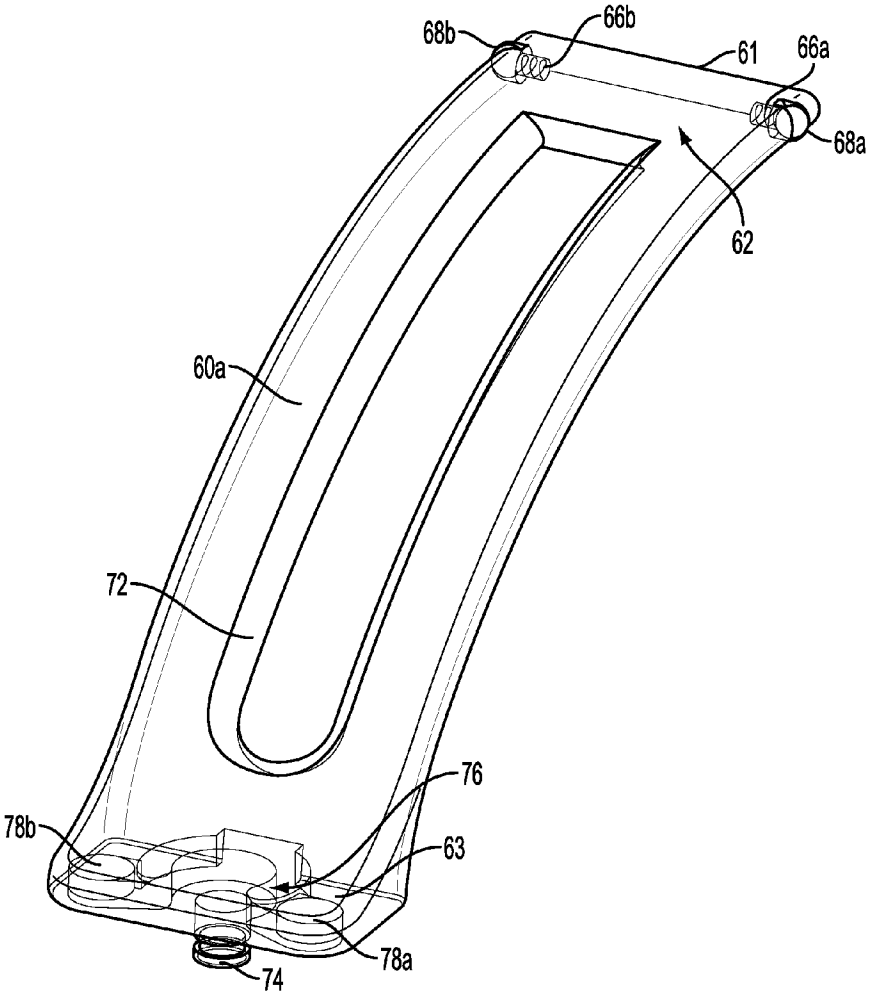
FIG. 13 is a perspective view of the arm of FIG. 12, shown in transparency, and including the spring-loaded bearings according to various embodiments of the present disclosure.
Figure 14:
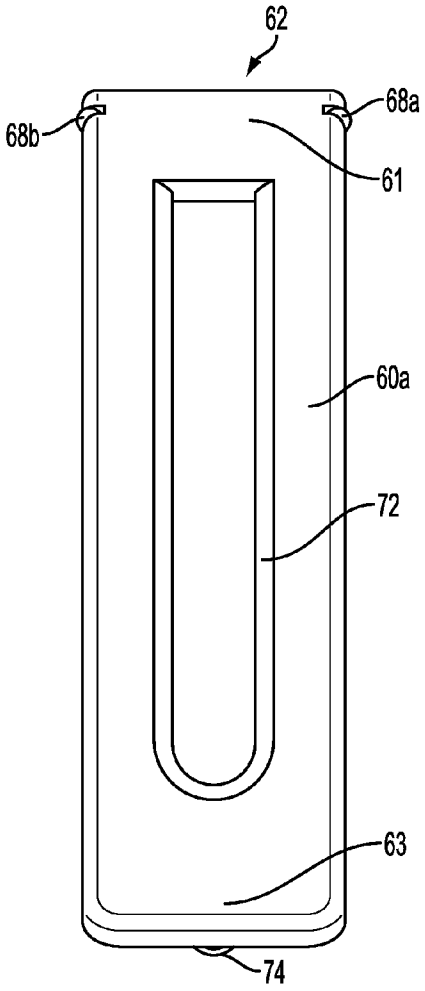
FIG. 14 is an elevational view of the arm of FIG. 12 according to various embodiments of the present disclosure.
Figure 15:
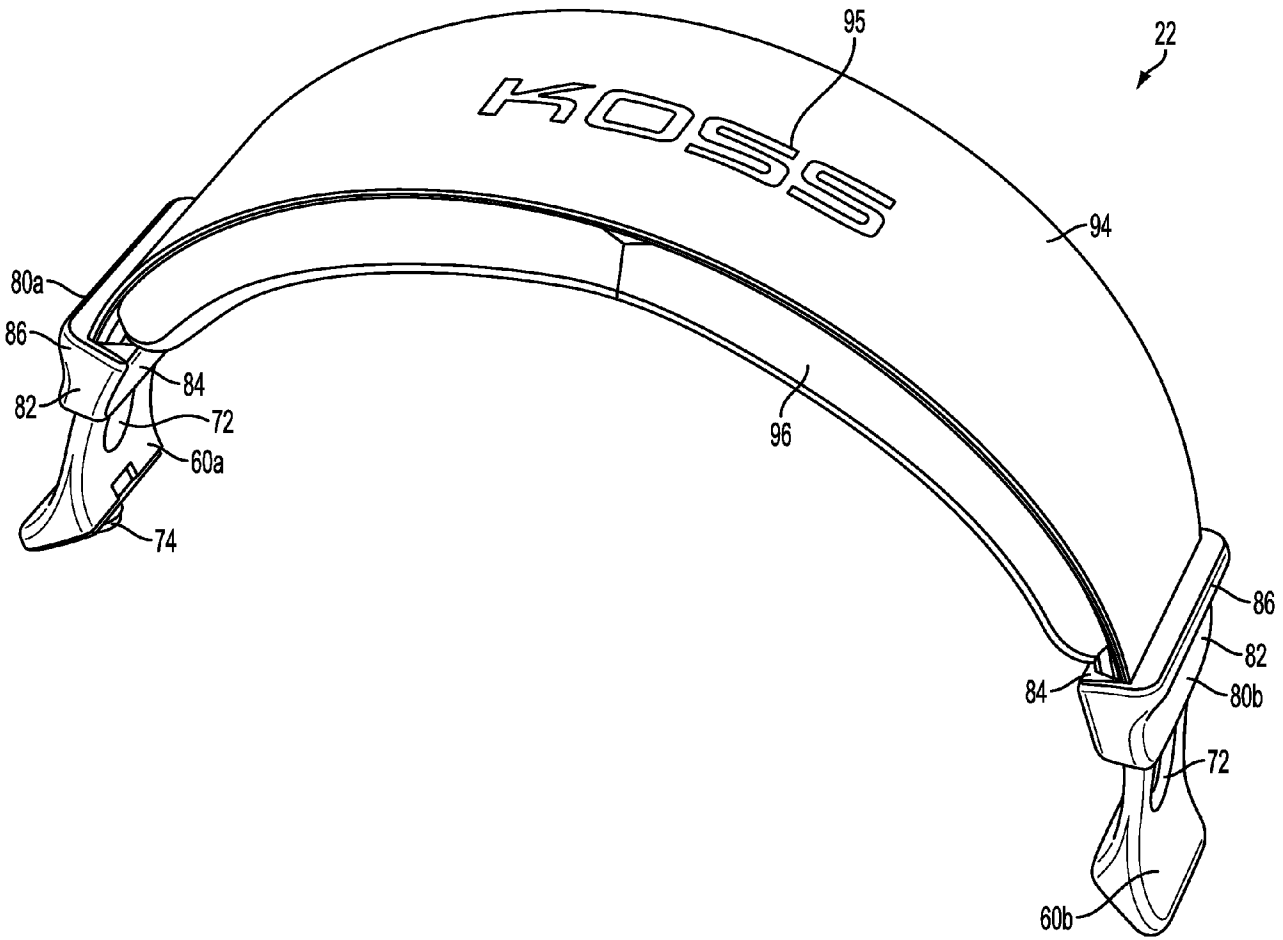
FIG. 15 is a perspective view of the headband assembly of FIG. 1 with a cushion and a covering according to various embodiments of the present disclosure.

Referring now to FIGS. 12-14, the extension arm 60*a* can have a contoured or arced body. The contour of the extension arm 60*a* can be selected such that the extension arm 60*a* comfortably fits on and/or around a portion of the user's head and/or neck, for example. Further, the contour of the extension arm 60*a* can match or substantially match the contour of the sleeve 40*a* such that the extension arm 60*a* can move smoothly within the sleeve 40*a* (FIG. 7), as described herein. Referring primarily to FIGS. 13 & 14, the extension arm 60*a* can include an opposing detent assembly 62. The opposing detent assembly 62 can include a pair of holes 64*a*, 64*b*, which can extend inwardly from a lateral side of the extension arm 60*a*. The first hole 64*a* can be positioned on a first lateral side of the extension arm 60, for example, and the second hole 64*b* can be positioned on an opposite lateral side of the extension arm 60, for example. In various embodiments, the holes 64*a*, 64*b* can be positioned near a first end 61 of the extension arm 60. Alternatively or additionally, detent holes 64*a*, 64*b* may be positioned elsewhere along the length of the extension arm 60.

Referring still to FIGS. 12-14, the opposing detent assembly 62 can include a pair of detent bearings 68*a*, 68*b*. The first detent bearing 68*a* can be positioned at least partially in the first hole 64*a*, for example, and the second detent bearing 68*b* can be positioned at least partially in the second hole 64*b*, for example. As described herein, each bearing 68*a*, 68*b* can engage the opposing detent arrangement 44 of the sleeve 40*a* (FIGS. 5-8). In various embodiments, the detent bearings 64*a*, 64*b* can be spring-loaded bearings. Accordingly, a first coil spring 66*a* can be positioned in the first hole 64*a* and can operably exert an outward springback force on the first detent bearing 68*a* positioned therein. Similarly, a second coil spring 66*b* can be positioned in the second hole 64*b* and can operably exert an outward springback force on the second detent bearing 68*b* positioned therein.

Figure 7:
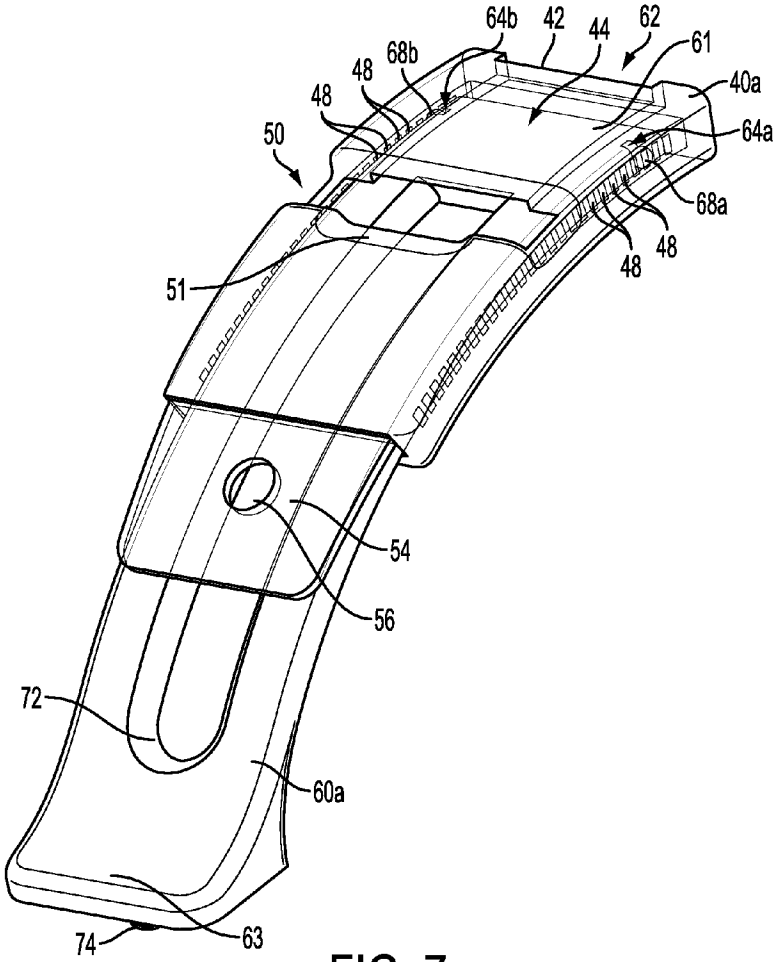
FIG. 7 is a perspective view of the sleeve of FIG. 5, shown in transparency, and an arm of the headband assembly of FIG. 1 according to various embodiments of the present disclosure.

Referring now primarily to FIG. 7, the extension arm 60*a* can be adjustably secured to the sleeve 40*a*. The first bearing 68*a* can adjustably engage one pocket 48 of the first plurality of detent pockets in the first channel 46*a* (FIG. 5) of the detent arrangement 44 and the second bearing 68*b* can adjustably engage one pocket 48 of the second plurality of detent pockets 48 in the second channel 46*b* (FIG. 5) of the detent arrangement 44. In various embodiments, the detent pockets 48 and the bearings 68*a*, 68*b* can be symmetrical. When the first bearing 68*a* engages one pocket 48 of the first plurality of pockets and the second bearing 68*b* engages one pocket 48 of the second plurality of pockets, the first and second bearings 68*a*, 68*b* can adjustably secure the arm 60*a* to the sleeve 40*a*. The opposing detent assembly 62 of the arm 60*a* and the opposing detent arrangement 44 of the sleeve 40 can provide for smooth and balanced adjustment of the arm 60*a* relative to the sleeve 40*a*. For example, as the first detent bearing 68*a* interfaces with the first plurality of detent pockets 48 in the first channel 46*a* and the second detent bearing 68*b* interfaces with the second plurality of detent pockets 48*a* in the second channel 46*b*, the springback forces generated by the opposing detent bearings 68*a*, 68*b* can be balanced. In other words, the springback force generated by the first detent bearing 68*a* on a first side of the sleeve 40*a* can match or substantially match the springback force generated by the second detent bearing 68*b* on an opposing side of the sleeve. Further, the forces can be balanced or substantially balanced as the detent bearings 68*a*, 68*b* of the arm 60*a* transition between detent pockets 48 of the sleeve 40*a*. The balance of forces can provide for a smoother adjustment or transition as the arm 60*a* extends and/or retracts relative to the sleeve 40*a*. In various embodiments, the opposing detent assembly 62 of the extension arm 60*a* can include a second pair of holes and a second pair of detent bearings. Similar to detent bearings 68*a*, 68*b*, the second pair of detent bearings may engage pockets 48 in the opposing detent arrangement 44 to adjustably secure the extension arm 60*a* to the sleeve 40*a*.

Referring again to FIG. 5, the sleeve 40*a* can include a retraction stop 52 that can limit movement of the arm 60*a* toward the spring band 30. In various embodiments, the retraction stop 52 can comprise a surface or wall at the end of the sleeve 40*a*. As the extension arm 60*a* (FIGS. 12-14) retracts into the sleeve 40, the first end 61 of the extension arm 60*a* can move towards the retraction stop 52 of the sleeve 50. When the first end 61 of the extension arm 60 engages or abuts the retraction stop 52, the retraction stop 52 can block the extension arm 60 such that further retraction of the extension arm 60*a* relative to the sleeve 40*a* is prevented.

Figure 21:
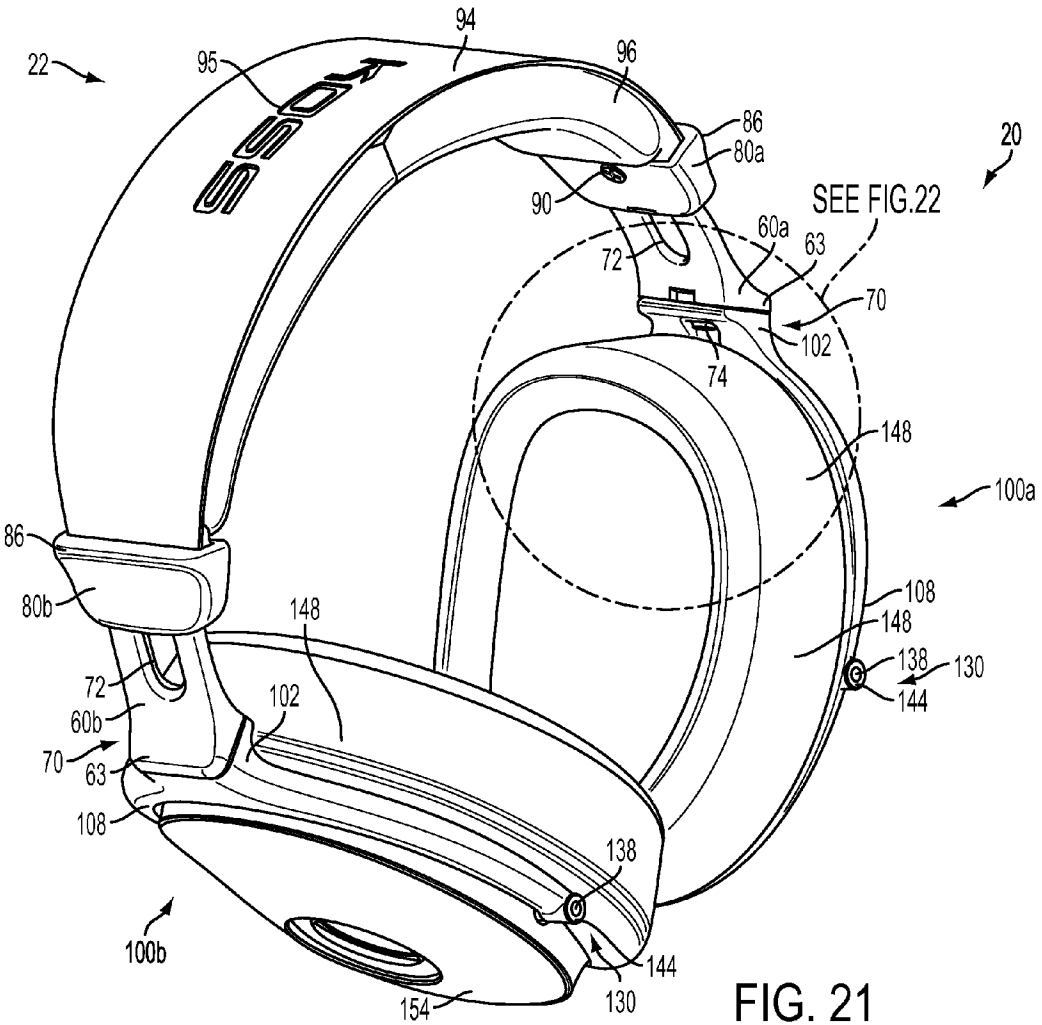
FIG. 21 is a perspective view of the headband assembly of FIG. 15 with personal speakers attached thereto according to various embodiments of the present disclosure.
Figure 22:
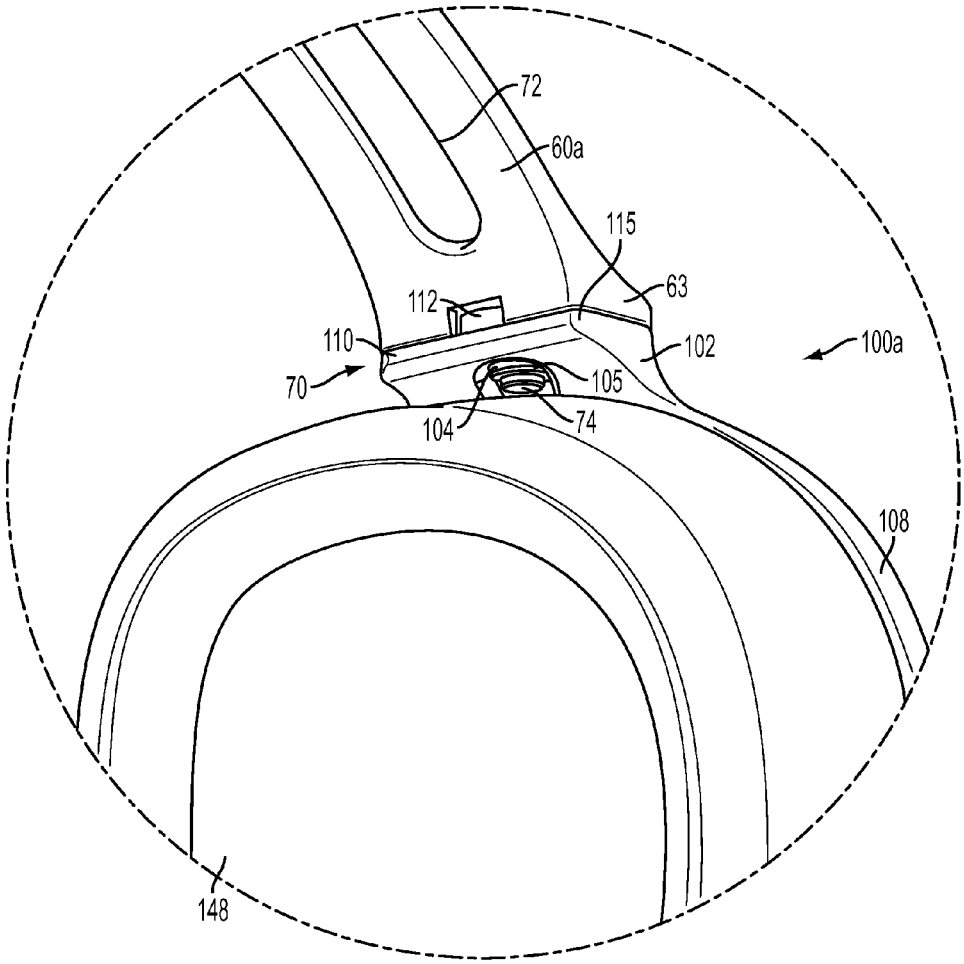
FIG. 22 is a detail, perspective view of a joint between the headband assembly and a personal speaker of FIG. 21 according to various embodiments of the present disclosure.

Referring again to FIGS. 12-14, the extension arm 60*a* can include a slot 72 therein. As described herein, the slot 72 can guide movement of the cap 80*a* (FIGS. 8-11) relative to the extension arm 60*a*. In various embodiments, the extension arm 60*a* can include an attachment element 74. The attachment element 74 can be positioned at or near a second end 63 of the extension arm 60, which can be substantially opposite from the first end 61 of the extension arm 60. As described herein, the attachment element 74 can facilitate attachment of the earpiece 100*a* (FIGS. 21 & 22). In various embodiments, the attachment element 74 and the extension arm 60 can be integrally formed. For example, the attachment element 74 can be an integral part of the extension arm 60. In certain other embodiments, the attachment element 74 and the extension arm 60 can comprise discrete components. For example, the attachment element 74 can comprise a pin, which can be secured to the extension arm 60. In at least one embodiment, the arm 60*a* can be approximately 3.5 inches by approximately 1.0 inches by approximately 3.0 inches with a radius of curvature of approximately 3 inches. In various embodiments, the dimensions of the arm 60*a*, including the radius of curvature, can be selected such that the arm 60*a* comfortably fits the user's head and/or neck. Additionally, the dimensions of the arm 60*a* can be selected such that the arm 60*a* smoothly interfaces with the other headband assembly 22 components such as the spring band 30, the sleeve 40*a* and/or the cap 80*a*, for example. In at least one embodiment, the arm 60*a* can comprise aluminum, for example. In various embodiments, the arm 60*a* can comprise various metallic and/or polymeric materials, for example.

Referring now to FIGS. 8-11, the cap 80*a* can include a two-part body and can be designed to guide and restrain movement of the arm 60*a* relative to the sleeve 40*a*. The cap 80*a* can be releasably fastened to the sleeve 40*a*. In certain embodiments, the cap 80*a* and the sleeve 40*a* can comprise an integrated component and/or can be permanently fastened together. Referring still to FIGS. 8-11, the cap 80*a* can include a first part 82 and a second part 84. The first part 82 of the cap 80*a* can include a grip portion 86. As described herein, a user can grasp the grip portion 86 to manipulate and move the sleeve 40*a* relative to the arm 60*a* when the cap 80*a* is secured to the sleeve 40*a*. The first part 82 of the cap 80*a* can also include a tubular protrusion 85, which can receive the fastener 90 to secure the first part 82 to the second part 84.

Referring primarily to FIG. 8, the cap 80*a* can attach to the wing 54 of the sleeve 40. For example, the fastener 90 can extend through the hole 56 (FIGS. 5-7) in the wing 54 of the sleeve 40*a* to fasten the first part 82 and the second part 84 to the wing 54. Furthermore, when the arm 60*a* is positioned relative to the sleeve 40*a* (FIG. 7), the cap 80*a* can be positioned around or partially around the arm 60*a*. In such embodiments, the tubular protrusion 85 of the cap 80*a* and the fastener 90 therein can extend through the slot 72 (FIG. 7) of the arm 60*a*. In other words, referring to FIGS. 1-3, when the cap 80*a*, the sleeve 40*a*, and the extension arm 80*a* are assembled, the fastener 90 and/or the tubular protrusion 85 can fit within the slot 72 of the arm 60*a* and the cap 80*a* can at least partially surround the arm 60*a*. Referring primarily to FIG. 11, the cap 80*a* can include windows 87 and/or an extension stop 88 between the windows 87. When the cap 80*a*, the sleeve 40*a*, and the arm 80*a* are assembled, the arm 60*a* can extend through the windows 87 of the cap 80 and the extension stop 88 can be positioned within the slot 72 of the arm 60*a*. In various embodiments, the slot 72 can guide the cap 80*a* and the attached sleeve 40*a* relative to the arm 60*a* as the sleeve 40*a* moves relative thereto. The extension stop 88 can limit movement of the arm 60*a* away from the spring band 30. In various embodiments, the extension stop 88 can comprise a surface or wall of the cap 80. As the extension arm 60*a* (FIGS. 12-14) extends from the sleeve 40*a*, the extension stop 88 can move towards the end of the slot 72 in the arm 60*a*.

When the extension stop 88 engages or abuts the end of the slot 72, the extension stop 88 can prevent further extension of the arm 60*a* relative to the sleeve 40*a*.

In at least one embodiment, the cap 80*a* can be approximately 1.5 inches by approximately 0.75 inches by approximately 0.5 inches. In various embodiments, the dimensions of the cap 80*a* can be selected such that the cap 80*a* comfortably fits the user's head and/or neck. Additionally, the dimensions of the cap 80*a* can be selected such that the cap 80*a* smoothly interfaces with the other headband assembly 22 components such as the sleeve 40*a* and/or the arm 60*a*, for example. In at least one embodiment, the cap 80*a* can comprise aluminum, for example. In various embodiments, the cap 80*a* can comprise various metallic and/or polymeric materials, for example.

Referring to FIGS. 15-20, the headband assembly 22 can include one spring band 30, two sleeves 40*a*, 40*b*, two extension arms 60*a*, 60*b*, and two caps 80*a*, 80*b*. As described herein, the headband assembly 22 components can be modular. Additionally, the components on a first side of the headband assembly 22 can have a corresponding or identical component on the second side of the headband assembly. In various embodiments, the first and second sides of the headband assembly can be mirror image reflections. In certain embodiments, the components of a headband assembly may not modular. Furthermore, the components on a first side of the headband assembly may not have corresponding or identical components on a second side of the headband assembly, for example.

Figure 16:
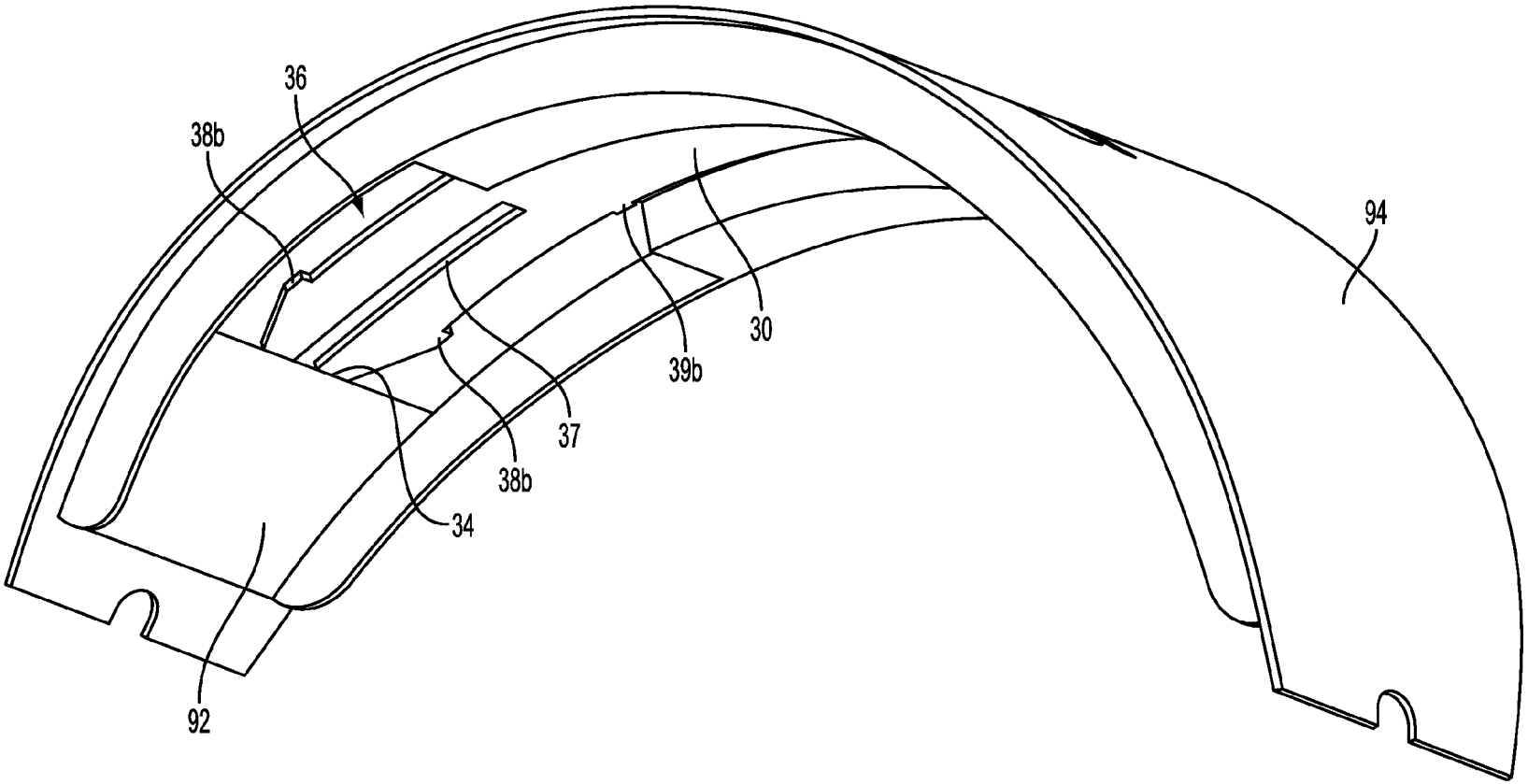
FIG. 16 is a perspective view of the spring band, a frame, and the covering of the headband assembly of FIG. 15 according to various embodiments of the present disclosure.
Figure 17:
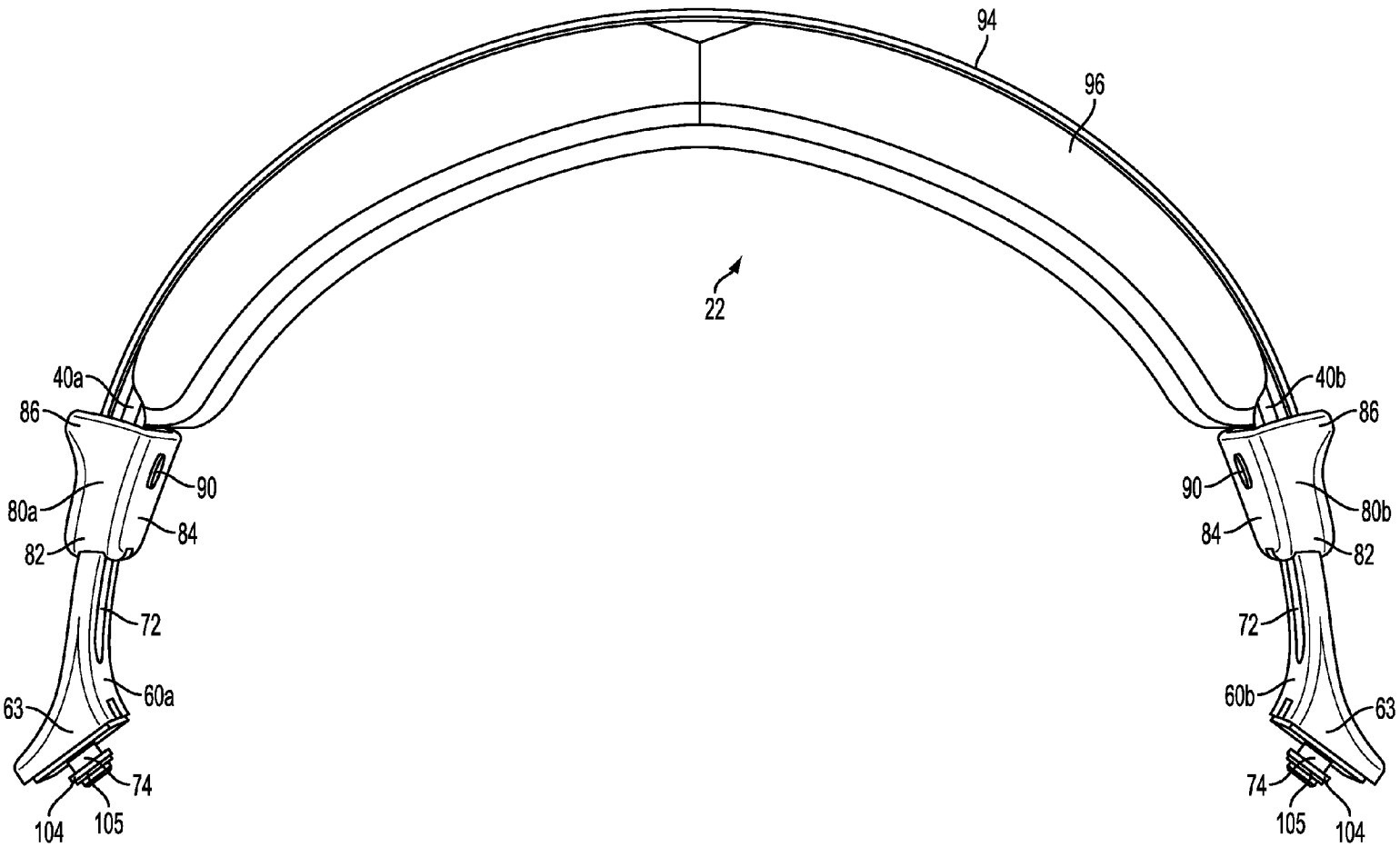
FIG. 17 is an elevational view of the headband assembly of FIG. 15 according to various embodiments of the present disclosure.
Figure 18:
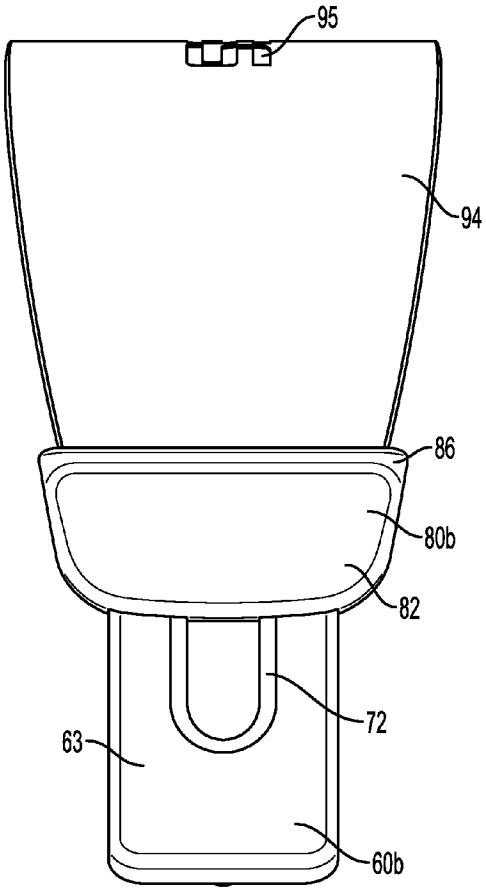
FIG. 18 is another elevational view of the headband assembly of FIG. 15 according to various embodiments of the present disclosure.
Figure 19:
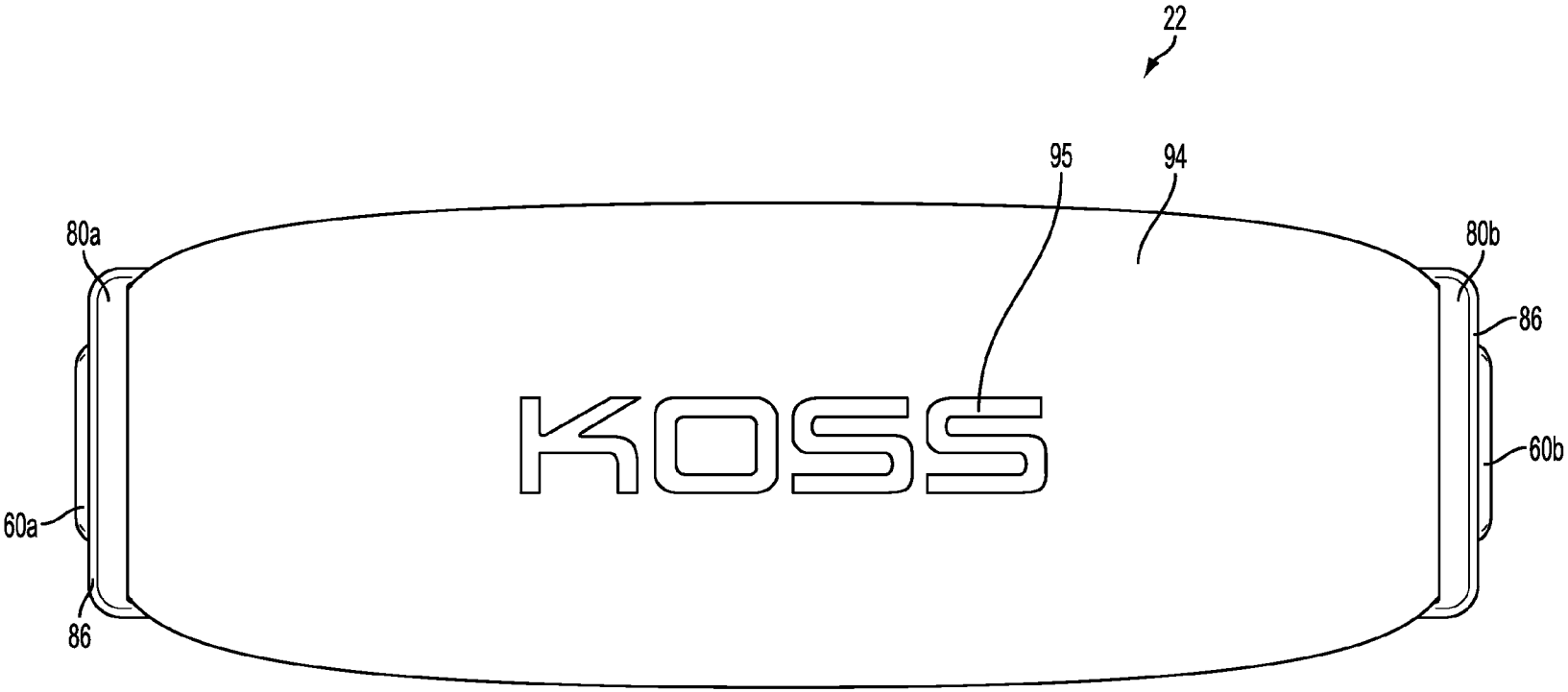
FIG. 19 is a plan view of the headband assembly of FIG. 15 according to various embodiments of the present disclosure.
Figure 20:
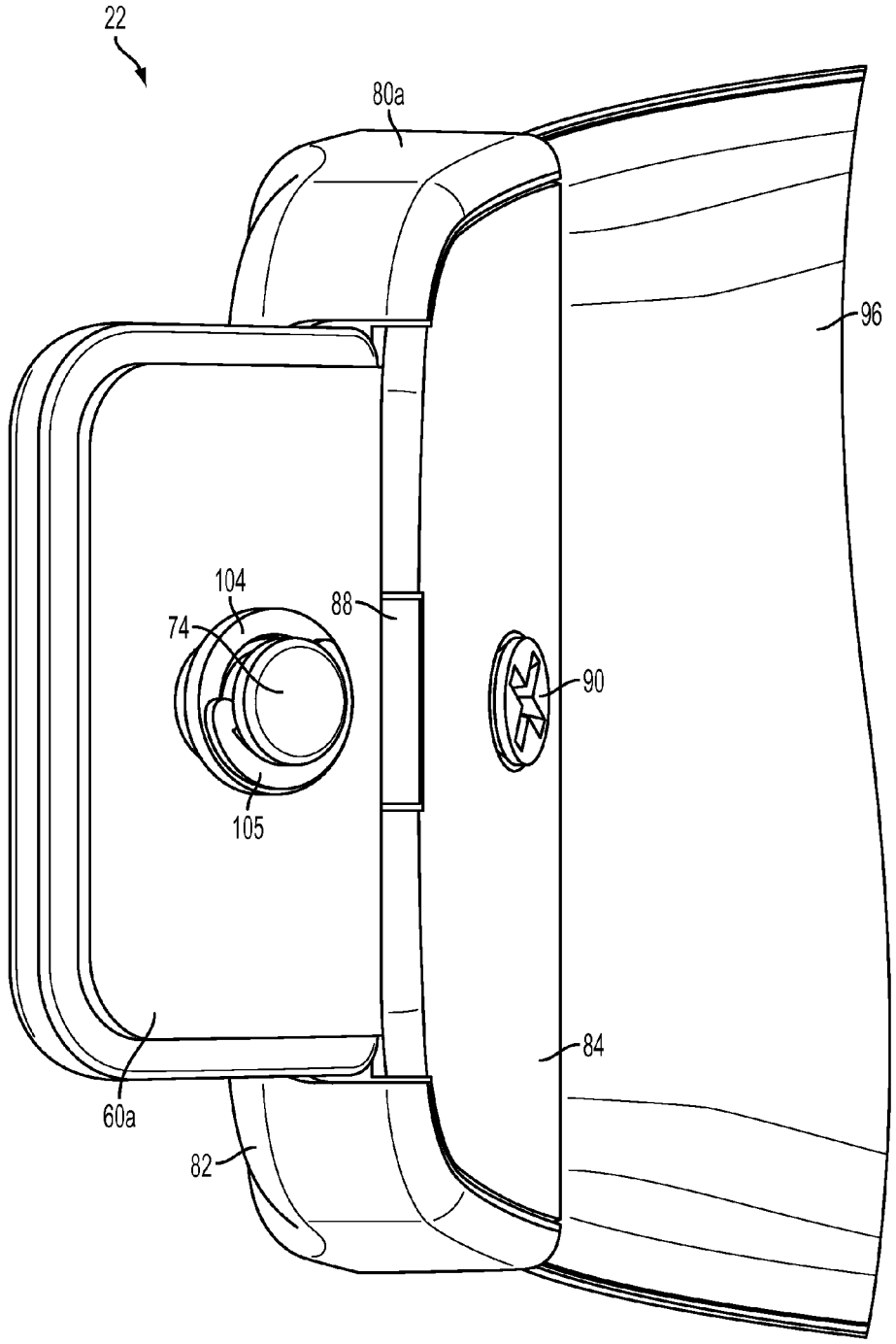
FIG. 20 is a partial, plan view of the headband assembly of FIG. 15 according to various embodiments of the present disclosure.

Referring primarily to FIG. 16, the headband assembly 22 can also include a frame 92. The spring band 30 of the headband assembly 22 can fit within the frame 92. In various embodiments, the frame 92 can provide a frame or structure for attachment of additional aesthetic components to the headband assembly 22. The frame 92 can be molded to fit the shape and dimensions of the spring band 30, the sleeves 40*a*, 40*b*, the arms 60*a*, 60*b*, and/or the caps 80*a*, 80*b*, for example. Referring again to FIGS. 15-20, the headband assembly 22 can include additional aesthetic components such as a covering 94 and/or a cushion 96. The cushion 96 can be a pad or foam cushion positioned between the user's head and/or neck and the spring band 30 and/or the sleeves 40*a*, 40*b*. In various embodiments, the covering 94 can cover the top surface of the frame 92 and/or the sides and/or the bottom surface of the cushion 96. Furthermore, the covering 94 can include indicia 95.

Figure 31:
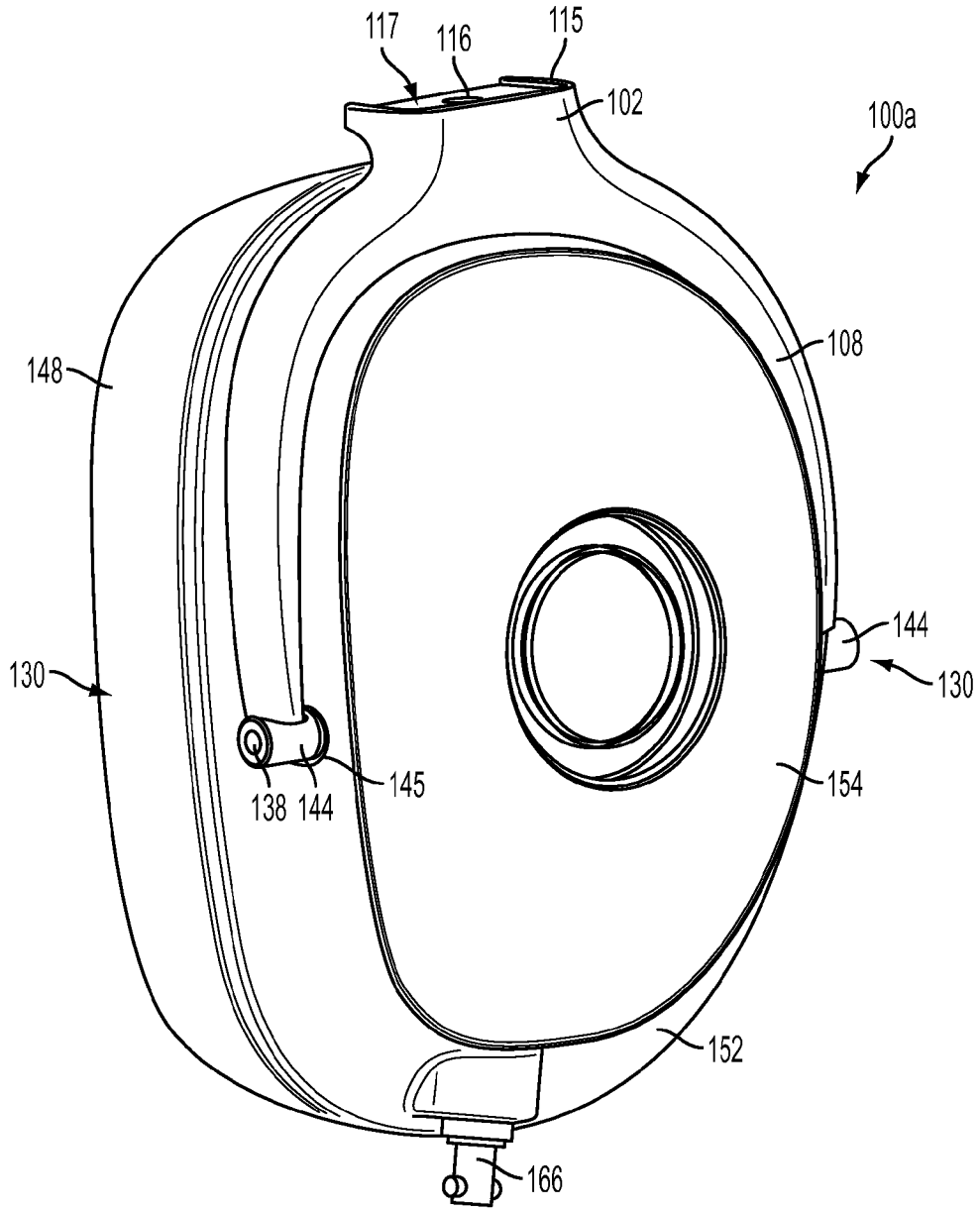
FIG. 31 is another perspective view of the personal speaker of FIG. 30 according to various embodiments of the present disclosure.

Referring now to FIGS. 21 and 22, the assembly 20 can include the personal speaker or earphone 100*a*, 100*b* attached or secured to the extension arm 60*a*, 60*b* by the attachment element 74. For example, the first earphone 100*a* can be attached to the first extension arm 60*a*, and the second earphone 100*b* can be attached to the second extension arm 60*b*. In various embodiments, the earphones 100*a*, 100*b* can comprise in-ear, over-ear and/or around-ear earphones. Various earphones have been proposed such as those described in U.S. Pat. No. 8,190,203, the entire disclosure of which is incorporated by reference herein. For example, the earphones 100*a*, 100*b*, can have a circular, elliptical, and/or polygonal perimeter and can be symmetrical or asymmetrical. Furthermore, the earphones 100*a*, 100*b* can include a clevis or yoke 108 secured to a housing ring 152 (FIG. 31). In various embodiments, the housing ring 152 can retain a speaker mount 150 (FIG. 32) and/or a speaker element 151 (FIG. 32) of the earphone 100*a*, 100*b*, for example. The yoke 108 can include an attachment section 102 that connects to the attachment element 74 of the arm 60*a*, 60*b*, for example. The attachment element 74 can engage the attachment section 102 and can be secured by a fastener, such as a retaining ring 105 (FIG. 22), for example.

In various embodiments, at least one of the earphones 100*a*, 100*b* can pivot relative to the headband assembly 22 to adjust the assembly 20. For example, the first earphone 100*a* can pivot relative to the first extension arm 60*a*, and/or the second earphone 100*b* can pivot relative to the second extension arm 60*b*. The first and/or second extension arms 60*a*, 60*b* can pivot at a magnetic pivot arrangement 70. In various embodiments, the first extension arm 60*a* can be pivotally connected to the first earphone 100*a*, for example, and the second extension arm 60*b* can be pivotally connected to the second earphone 100*b*, for example. Further, as described herein, the yoke 108 of one or more earphones 100*a*, 100*b* can be pivotally connected to an earphone housing ring 152 (FIG. 31) of the respective earphone 100*a*, 100*b*. The yoke 108 can pivot relative to the housing ring 152 at a housing pivot arrangement 130 (FIG. 31), for example.

Referring to FIGS. 21-24, the first earphone 100*a* can be pivotally connected to the first extension arm 60*a* by the magnetic pivot arrangement 70. Similarly, in certain embodiments, the second earphone 100*b* can be pivotally connected to the second extension arm 60*b* by another magnetic pivot arrangement. In various embodiments, the magnetic pivot arrangement 70 can include a magnetic element 78*a* in the extension arm 60*a*, and a magnetic element 122*a* in the yoke 108 of the attached earphone 100*a*. For example, the magnetic element 78*a* in the first extension arm 60*a* can pivot into and/or out of alignment with the magnetic element 122*a* in the yoke 108 as the first extension arm 60*a* pivots relative to the first earphone 100*a*. In various embodiments, the magnetic pivot arrangement 70 can include a pair of magnetic pivot elements 78*a*, 78*b* in the extension arm 60*a*, and a pair of magnetic pivot elements 78*a*, 78*b* in the yoke. In certain embodiments, the magnetic pivot arrangement 70 can include additional magnetic elements. As described herein, the magnetic elements 78*a*, 78*b*, 122*a*, 122*b* can seek to maintain alignment such that the magnetic elements 78*a*, 78*b*, 122*a*, 122*b* exert a force on the extension arm 60*a* and/or the yoke 108 that pivots the extension arm 60*a* relative to the yoke, for example.

Figure 23:
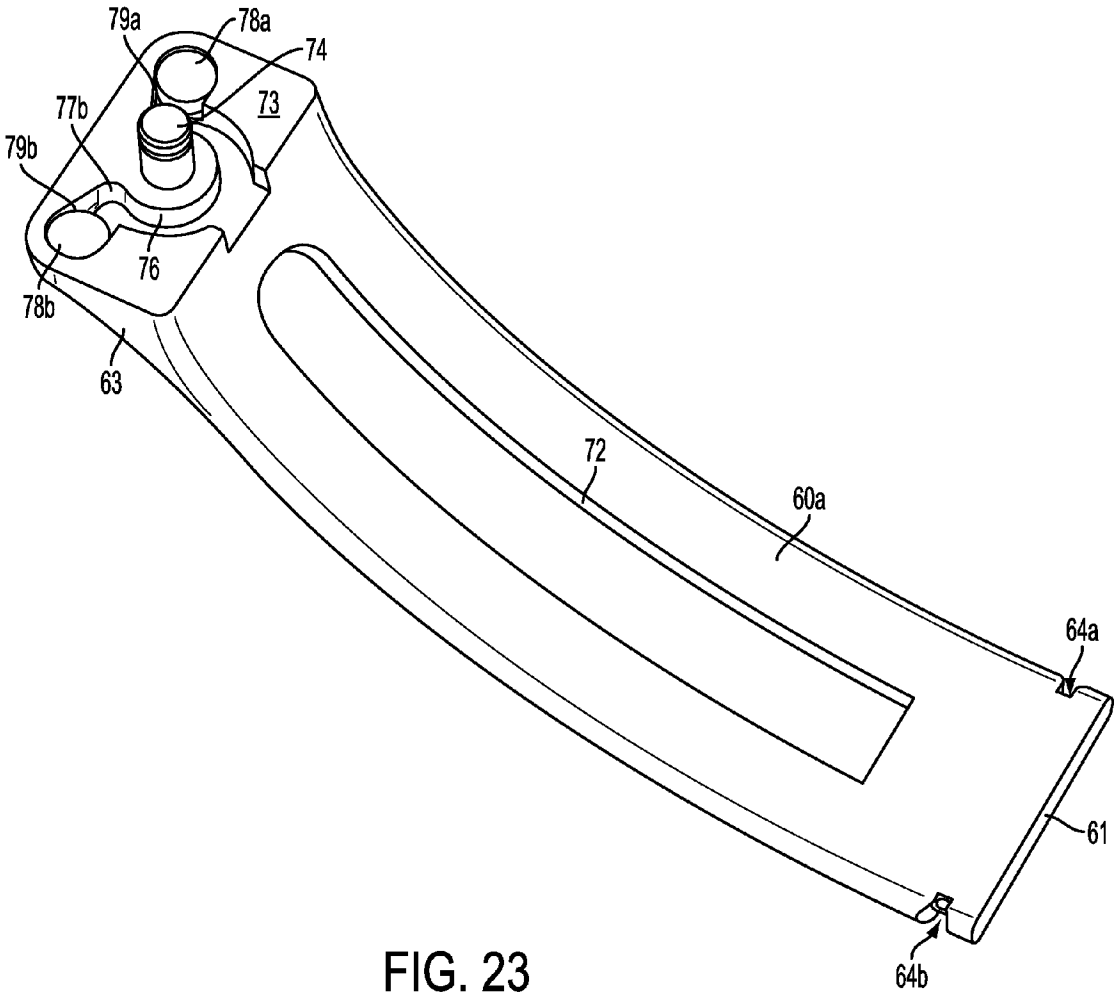
FIG. 23 is a perspective view of the arm of FIG. 12 with magnetic elements embedded therein according to various embodiments of the present disclosure.

Referring to FIG. 23, the second end 63 of the extension arm 60*a* can include the first pair of magnetic elements 78*a*, 78*b* of the magnetic pivot arrangement 70. Furthermore, the first extension arm 60*a* can include a bearing surface 73, and a first pair or recesses 79*a*, 79*b* extending from the bearing surface 73 into the body of the extension arm 60*a*. In various embodiments, each magnetic element 78*a*, 78*b* can be embedded in a corresponding recess 79*a*, 79*b* in the extension arm 60*a*. For example, the magnetic element 78*a* can be at least slightly recessed in the recess 79*a* of the extension arm 60*a*, such that no portion of the magnetic element 78*a* projects beyond the bearing surface 73. Further, the magnetic element 78*b* can be at least slightly recessed in the recess 79*b* of the extension arm 60*a*, such that no portion of the magnetic element 78*a* projects beyond the bearing surface 73, for example. Referring still to FIG. 23, the extension arm 60*a* can include a groove 76 that extends from the bearing surface 73 into the body of the first extension arm 60*a*. The groove 76 can form a curved profile in the second end 63 of the first extension arm 60*a*, for example. In other words, the groove 76 can define a contour, which can have a radius of curvature. As described herein, the groove 76 can be configured to moveably receive a protrusion 112 (FIG. 25) that extends from the yoke 108 (FIG. 24) as the extension arm 60*a* pivots relative to the yoke 108 of the first earphone 100*a* (FIG. 21).

Figure 24:
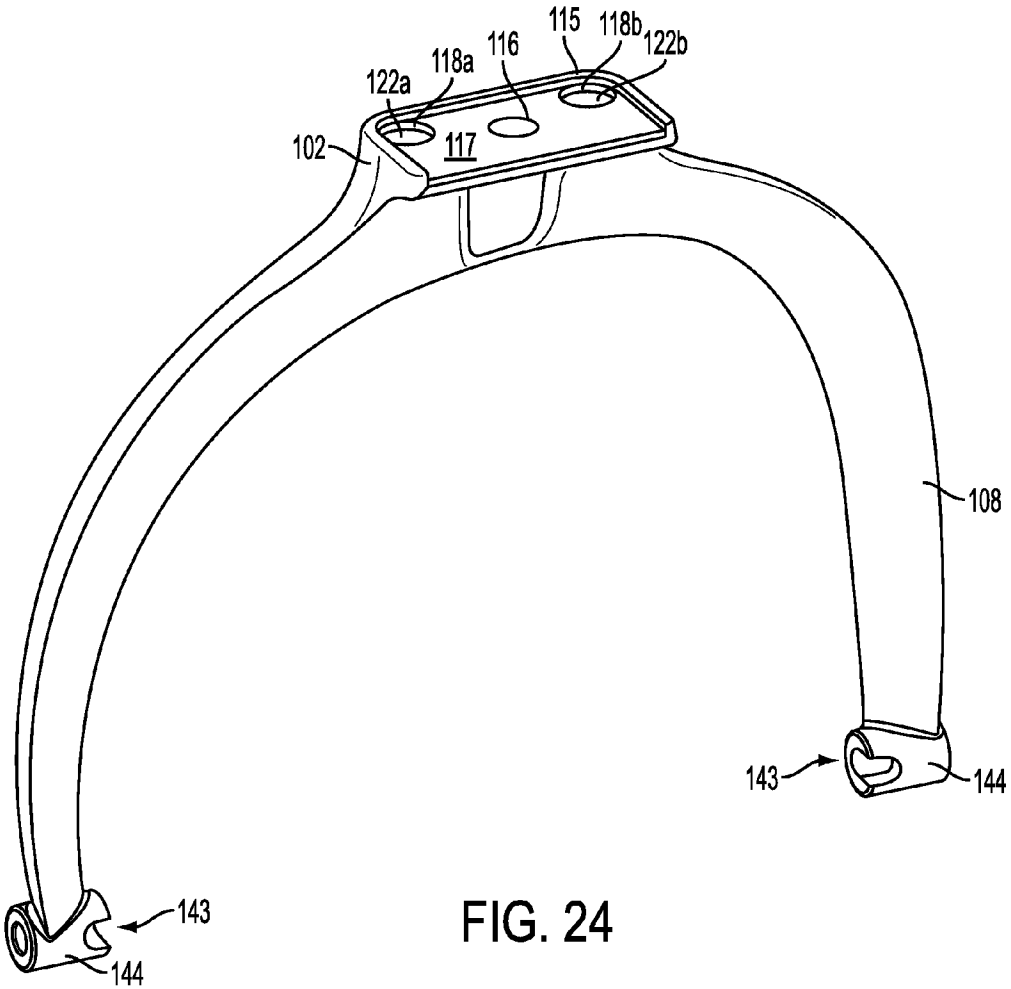
FIG. 24 is a perspective view of the yoke of a personal speaker of FIG. 21, including magnetic element embedded therein according to various embodiments of the present disclosure.

Referring to FIG. 24, the attachment portion 102 of the yoke 108 can include the second pair of magnetic elements 122*a*, 122*b*. Furthermore, the attachment portion 102 can include a second pair of recesses 118*a*, 118*b* that can extend from a mating surface 117 of the yoke 108 into the body of the yoke 108. In various embodiments, each magnetic element 122*a*, 122*b* can be embedded in a corresponding recess 118*a*, 118*b* in the attachment portion 102 of the yoke 108. For example, the magnetic element 122*a* can be at least slightly recessed in the recess 118*a* of the yoke 108, such that no portion of the magnetic element 122*a* projects beyond the mating surface 117. Further, the magnetic element 122*b* can be at least slightly recessed in the recess 122*b* of the yoke 108, such that no portion of the magnetic element 122*a* projects beyond the mating surface 117, for example. Referring still to FIG. 24, the attachment portion 102 of the yoke 108 can include an aperture 116 that extends through the yoke 108. The aperture 116 can be configured to receive the attachment element 74 (FIG. 23) of the first extension arm 60*a* (FIG. 23) when the first extension arm 60*a* is positioned relative to the yoke 108, for example.

Figure 25:
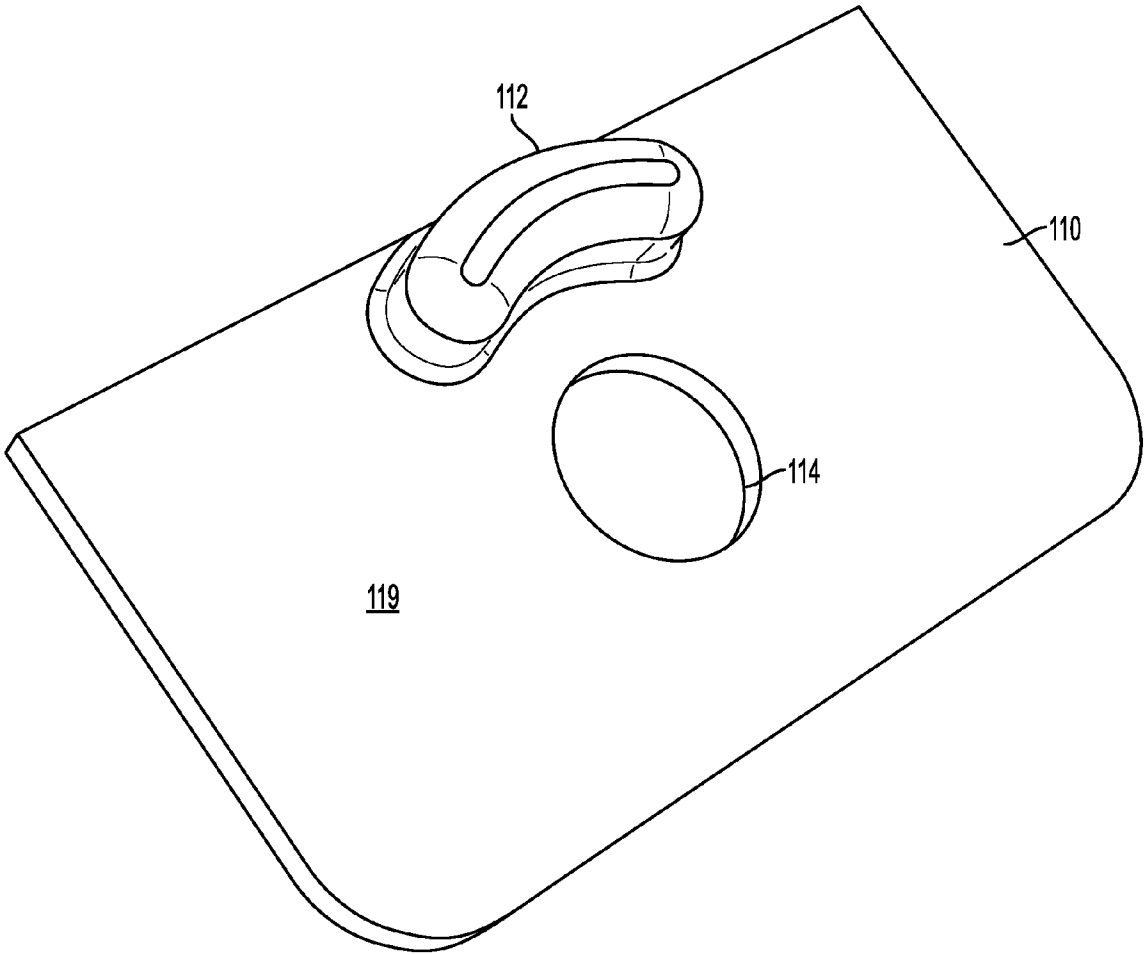
FIG. 25 is a perspective view of a pivot plate according to various embodiments of the present disclosure.
Figure 26:
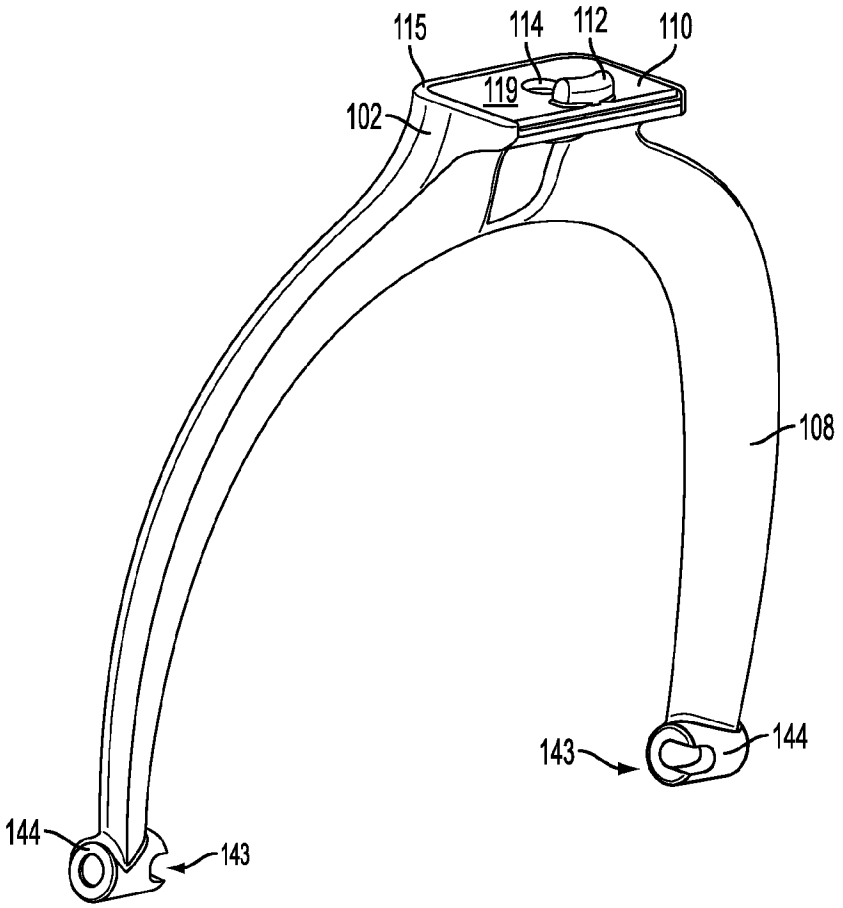
FIG. 26 is a perspective view of the yoke of FIG. 24 and the pivot plate of FIG. 25 according to various embodiments of the present disclosure.
Figure 27:
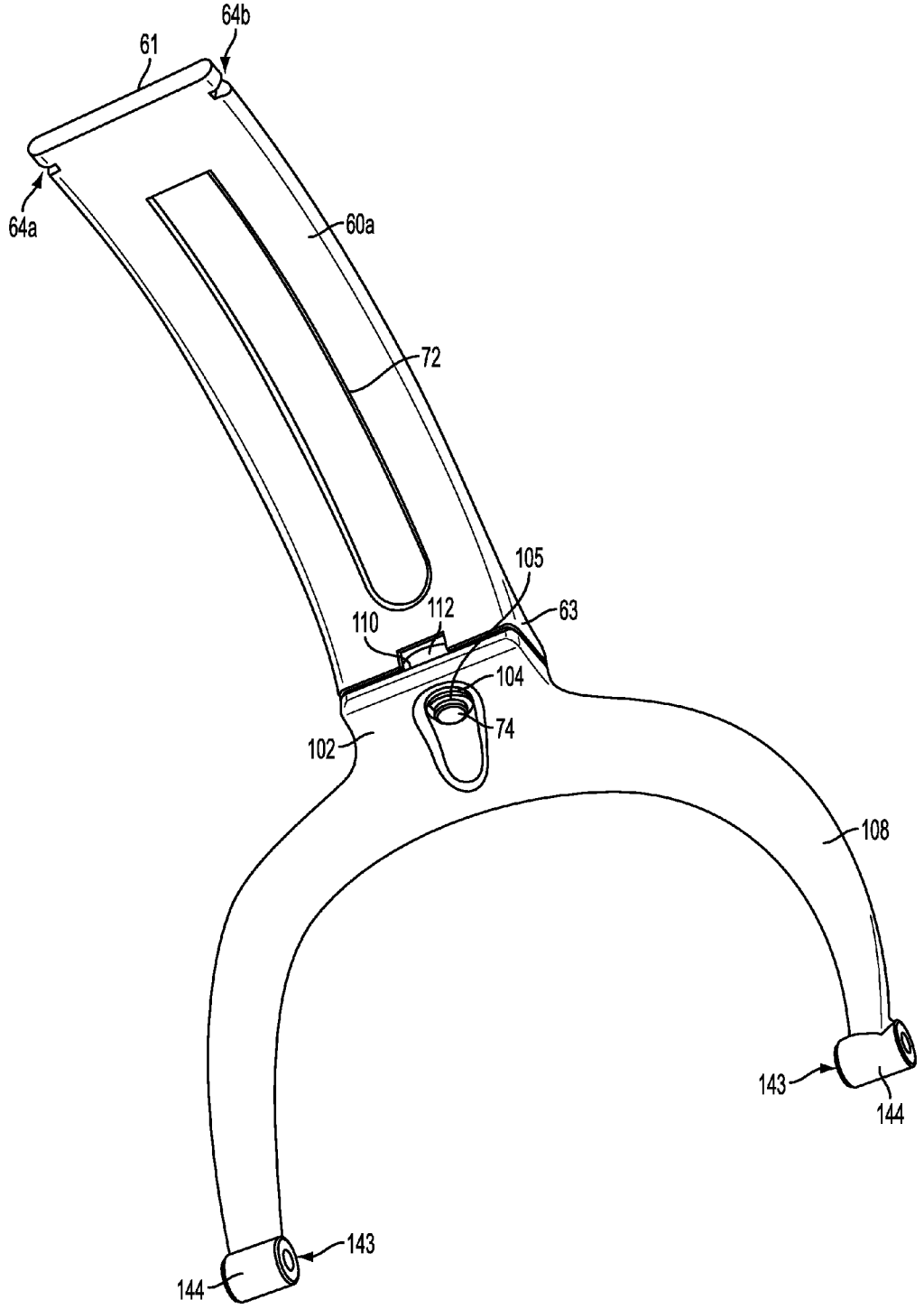
FIG. 27 is a perspective view of the yoke and the pivot plate of FIG. 26 secured to the arm of FIG. 23 according to various embodiments of the present disclosure.

Referring now to FIGS. 25 and 26, the magnetic pivot arrangement 70 can include a pivot plate 110, which can include the protrusion 112. In various embodiments, the protrusion 112 can form a curved profile that can match or substantially match the profile of the groove 76 (FIG. 23). In other words, the protrusion 112 can define a contour, which can have a radius of curvature that matches the radius of curvature of the groove 76 contour. For example, at least a portion of the groove 76 can have a radius of curvature of approximately 0.15 inches to approximately 0.25 inches, and at least a portion of the protrusion 112 can have a radius of curvature of approximately 0.2 inches. Furthermore, the protrusion 112 can have a width that is at least slightly smaller than the width of the groove 76 such that the protrusion 112 or at least a portion thereof can fit within the groove 76. For example, the width of the groove 76 can be approximately 0.95 inches to approximately 0.105 inches, and the width of the protrusion 112 can be approximately 0.09 inches to approximately 0.094 inches. In various embodiments, the difference between the width of the protrusion 112 and the width of the groove 76 can approximately 0.001 inches to approximately 0.015 inches. In at least one embodiment, the groove 76 can guide the protrusion 112 as the protrusion 112 moves therein. For example, the protrusion 112 can slide along at least a length of the groove 76 when the pivot plate 110 is positioned relative to the first extension arm 60*a*. In various embodiments, the length of the protrusion can be approximately 20% to approximately 30% the length of the groove 76, for example. Referring still to the FIG. 25, the pivot plate 110 can include an aperture 114 therethrough. In various embodiments, the aperture 114 can be configured to receive the attachment element 74 (FIG. 23) of the first extension arm 60*a* (FIG. 23) when the pivot plate 110 is positioned relative to the second extension arm 60*a*, for example as illustrated in FIG. 27. As described herein, the attachment element 74 can pivot in the aperture 114 of the pivot plate 110 as the extension arm 60*a* pivots relative to the yoke 108 of the first earphone 100*a*.

Referring to FIGS. 24-26, the pivot plate 110 can be secured to the attachment section 102 of the yoke 108. In various embodiments, the yoke 108 can include a mating surface 117, and a rim 115, which can extend from the mating surface 117. The rim 115 can surround or partially surround the mating surface 117 of the attachment section 102, for example. In various embodiments, the pivot plate 110 can be positioned relative to the attachment section 102 of the yoke 108, such that the pivot plate 110 nests in the attachment section 102. For example, the pivot plate 110 can be positioned flush with the mating surface 117, and the rim 115 can extend at least partially around the perimeter of the pivot plate 110, for example. In various embodiments, the rim 115 can help to retain the pivot plate 110 relative to the yoke 108. For example, the rim 115 can surround or partially surround the pivot plate 110 to prevent lateral movement of the pivot plate 110 relative to the yoke 108. In certain embodiments, at least a portion of the pivot plate 110 can be substantially flush with the rim 115 of the yoke 108, and the protrusion 112 can extend beyond the rim 115 of the yoke 108, for example. The pivot plate 110 can be non-pivotally secured to the attachment section 102 of the yoke 108 such that the projection 112 remains fixed relative to the yoke 108 as the first extension arm 60*a* pivots relative to yoke 108 and the first earpiece 100*a*. Referring again to FIG. 25, when the pivot plate 110 is secured to the yoke 108, the pivot plate 110 can enclose and/or retain the magnetic elements 122*a*, 122*b* in the recessions 118*a*, 118*b* of the attachment section 102. For example, the pivot plate 110 can cover the magnetic elements 122*a*, 122*b* positioned in the yoke 108. In various embodiments, the pivot plate 110 can be positioned between the magnetic elements 78*a*, 78*b* positioned in the extension arm 60*a* and the magnetic elements 122*a*, 122*b* positioned in the yoke 108. For example, the pivot plate 110 can extend between the pairs of magnetic elements 78*a*, 78*b*, 122*a*, 122*b*.

Figure 28:
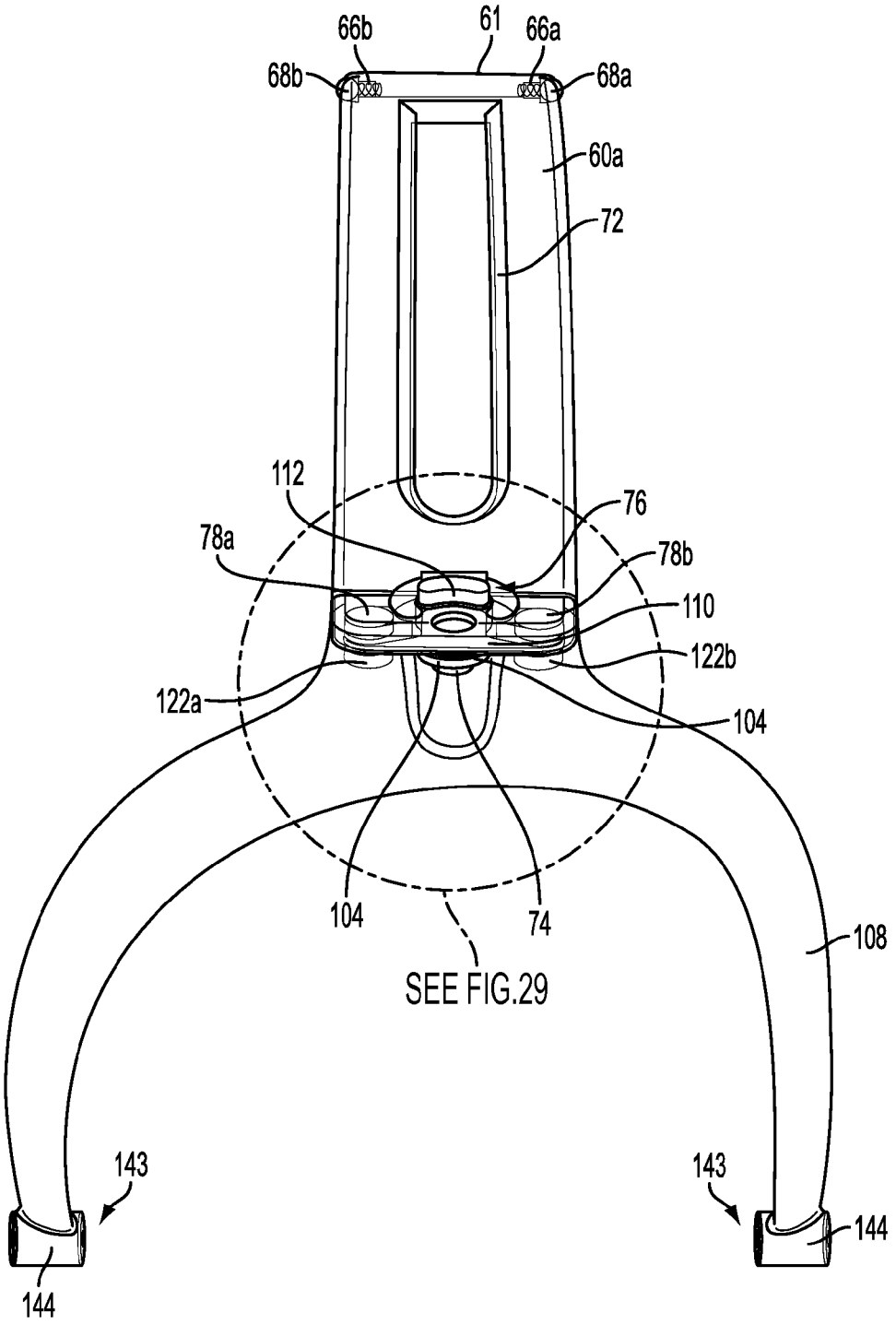
FIG. 28 is an elevational view of the yoke, the pivot plate, and the arm of FIG. 27, with multiple components shown in transparency, according to various embodiments of the present disclosure.
Figure 29:
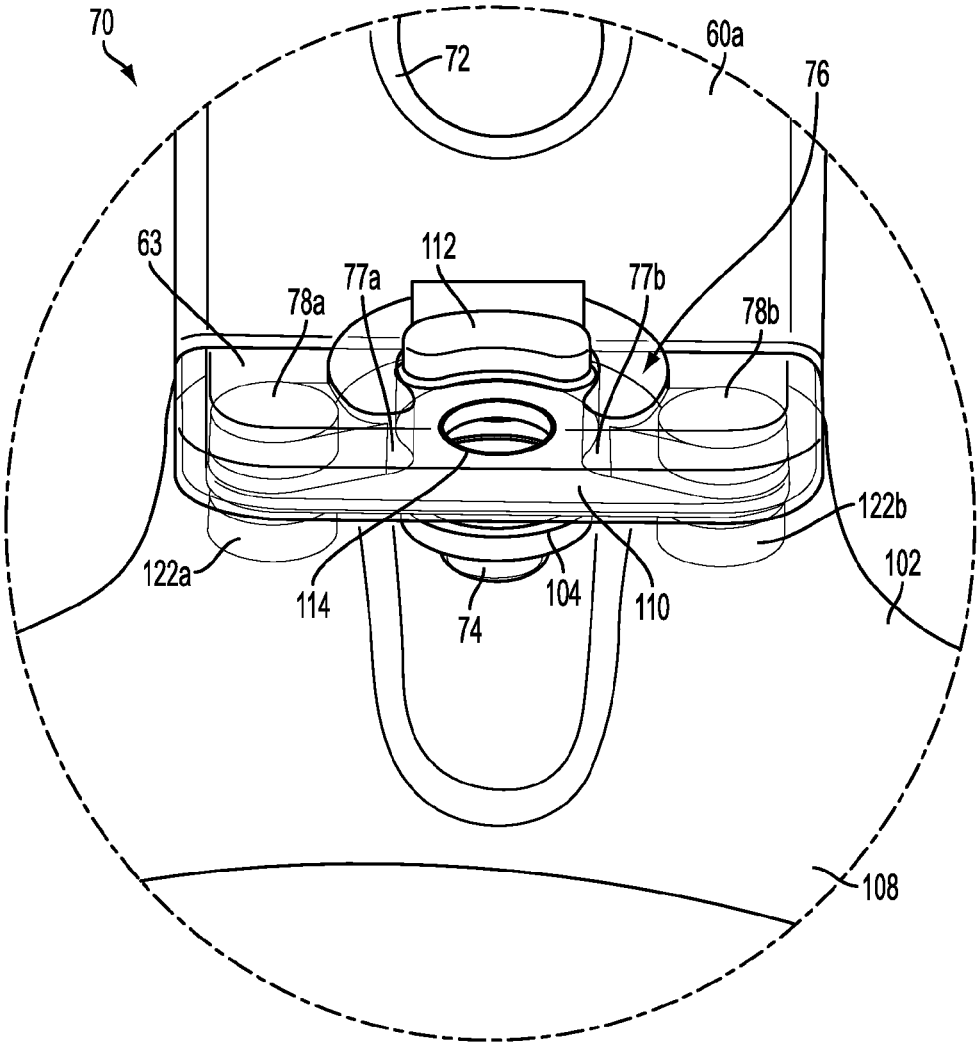
FIG. 29 is a detail, elevational view of the yoke, the pivot plate, and the arm of FIG. 28, with multiple components shown in transparency, according to various embodiments of the present disclosure.
Figure 30:
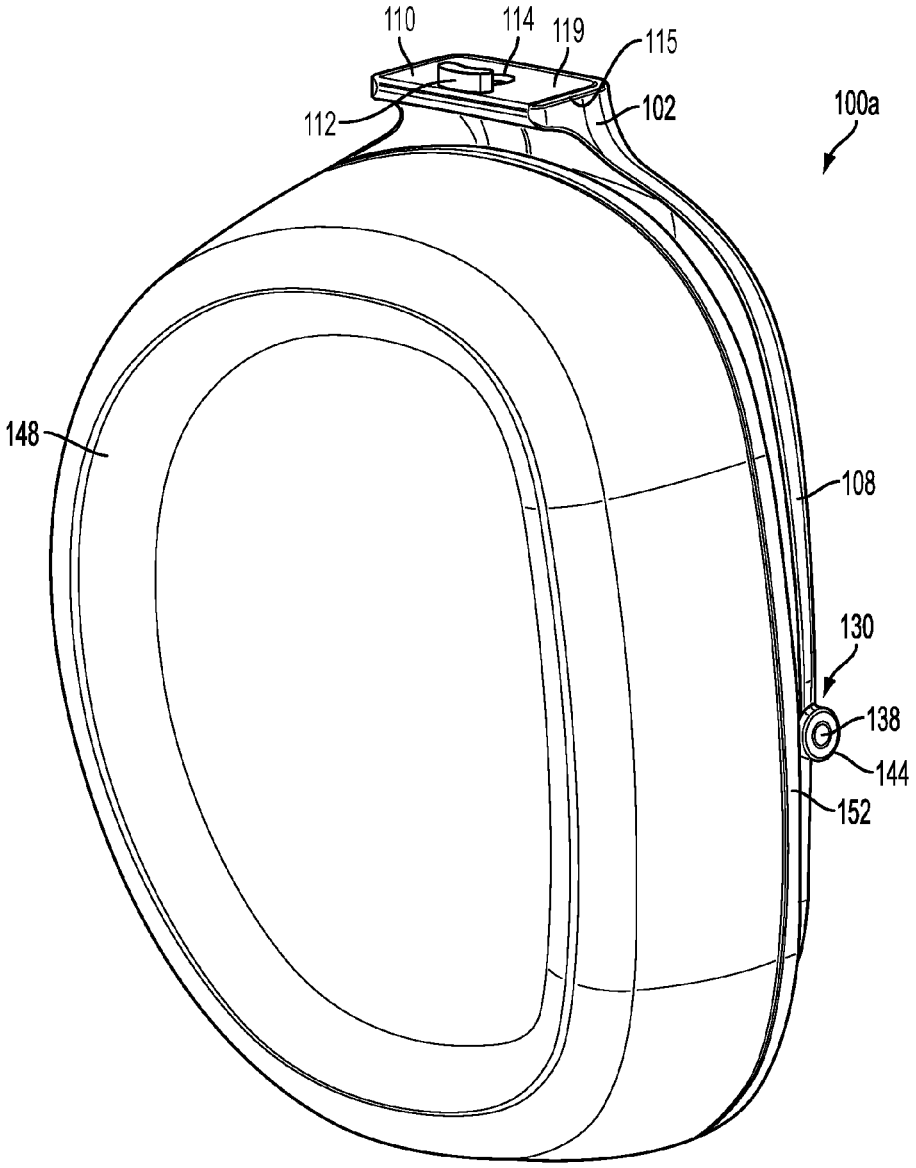
FIG. 30 is a perspective view of the personal speaker of FIG. 21 according to various embodiments of the present disclosure.

Referring now to FIGS. 27-29, the retaining ring 105 can secure the yoke 108 to the extension arm 60*a*. In various embodiments, the bearing surface 74 (FIG. 23) of the extension arm 60*a* can be positioned relative to the bearing surface 119 (FIGS. 25 and 26) of the pivot plate and the yoke 108. For example, the bearing surface 119 of the pivot plate can be adjacent to, flush with and/or abutting the bearing surface 74 of the extension 60*a*. The bearing surfaces 74, 119 can be configured to pivot relative to each other, for example. In at least one embodiment, the attachment element 74 of the first extension arm 60*a* can extend through the aperture 114 in the pivot plate 110 and/or through the aperture 116 in the attachment section 102 of the yoke 108. In various embodiments, the retaining ring 105 can grip the attachment element 74 between a distal shoulder of the attachment element 74 and the yoke 108. The retaining ring 105 can hold the attachment element 74 within the apertures 114, 116 to secure the first extension arm 60*a* relative to the yoke 108, for example. In various embodiments, a shouldered portion of the attachment element and/or a washer 104 can be positioned between the retaining ring 105 and the yoke 108.

Referring still to FIGS. 27-29, when the attachment element 74 engages the yoke 108 to secure the first extension arm 60*a* to the yoke 108, the pivot plate 110 can be positioned and held therebetween. In other words, the pivot plate 110 can be sandwiched between the first extension arm 60*a* and the yoke 108, for example. In certain embodiments, the attachment element 74 and the retaining ring 105 can secure the pivot plate 110 between the yoke 108 and the first extension arm 60*a*. Additionally or alternatively, the pivot plate 110 can be integrally formed with the yoke 108. In various embodiments, the pivot plate 110 can be fixedly secured to the yoke 108, and the protrusion 112 can extend into the groove 76 in the extension arm 60*a*. Further, in at least one embodiment, the attachment element 74 of the first extension arm 60*a* can pivot in the apertures 114, 116 (FIGS. 24 and 25) of the yoke 108 as the first extension arm 60*a* pivots relative to the yoke 108. As the attachment element 74 pivots in the apertures 114, 116, the protrusion 112 extending from the pivot plate 110 can slide in the groove 76 of the extension arm 60*a*.

Referring primarily to FIG. 29, the groove 74 can include rotational stops 77*a*, 77*b*. In various embodiments, the attachment element 74 can pivot in a first direction relative to the yoke 108 until the protrusion 112 in the groove 76 abuts the first rotational stop 77*a*, and the attachment element 74 can pivot in a second, opposite direction relative to the yoke 108 until the protrusion 112 in the groove 76 abuts the second rotational stop 77*b*. In other words, the rotational stops 77*a*, 77*b* can limit the range of rotation of the first extension arm 60*a* relative to the yoke 108. In various embodiments, the rotational stops 77*a*, 77*b* of the groove 76 can permit approximately +/−90 degrees or rotation, or 180 degrees of rotation, for example. In other embodiments, the rotational stops 77*a*, 77*b* of the groove 76 can permit less than 180 degrees or more than 180 degrees, for example. In at least one embodiment, the groove 76 can comprise a complete loop or contour such that the groove 76 does not include rotational stops 77*a*, 77*b*. In certain embodiments where the groove 76 forms a complete loop, the extension arm 60*a* can rotate+/−360 degrees, for example.

In various embodiments, when the first extension arm 60*a* pivots relative to the yoke 108, the magnetic elements 78*a*, 78*b* in the extension arm 60*a* can pivot relative to the magnetic elements 122*a*, 122*b* in the yoke 108. The magnetic poles of the magnetic elements 78*a*, 78*b*, 122*a*, 122*b* can be arranged such that the magnetic elements 78*a*, 78*b* in the first extension arm 60*a* seek to substantially align with the corresponding magnetic elements 122*a*, 122*b* in the yoke 108. For example, the magnetic element 78*a* can seek alignment with the magnetic element 122*a*, and the magnetic element 78*b* can seek alignment with the magnetic element 122*b*. In various embodiments, when the yoke is pivoted away from a neutral position and into a second, pivoted position, as described herein, a magnetic attraction between the magnetic element 78*b*, for example, and the magnetic element 122*b*, for example, can pull the magnetic poles of the magnetic elements 78*b*, 122*b* toward alignment. In other words, the magnetic element 78*a* can exert a magnetic pulling force on magnetic element 122*a*, and magnetic element 78*a* can exert a magnetic pulling force on magnetic element 122*b*. Further, in various embodiments, the magnetic element 78*a* can resist alignment with the magnetic element 122*b*, and the magnetic element 78*b* can resist alignment with the magnetic element 122*a*, for example. For example, when yoke is pivoted away from a neutral position and into a second pivoted position, as described herein, the magnetic element 78*a* can exert a magnetic pushing force on magnetic element 122*b*, and magnetic element 78*b* can exert a magnetic pushing force on magnetic element 122*b*. In various embodiments, the magnetic elements 78*a*, 78*b*, 122*a*, 122*b* can be made of hard, magnetic material. The magnetic elements 78*a*, 78*b*, 122*a*, 122*b* can be permanent magnets, for example.

In various embodiments, the yoke 108 can pivot between a neutral position and pivoted positions. For example, the yoke 108 can pivot between a first neutral position, a counterclockwise second position, and clockwise second position. The first position can be between the counterclockwise second position and the clockwise second position, for example. In various embodiments, the magnetic element 78*a* can be aligned with the magnetic element 122*a* and the magnetic element 78*b* can be aligned with the magnetic element 122*b* when the yoke 108 is in the first, neutral position relative to the extension arm 60*a*. When the yoke 108 pivots toward the counterclockwise or clockwise second position, the magnetic element 78*a* can move out of alignment with magnetic element 122*a* and the magnetic element 78*b* can move out alignment with the magnetic element 122*b*. As the yoke 108 pivots toward the clockwise second position, magnetic element 78*a* can move toward alignment with the magnetic element 122*b*. In various embodiments, the poles of magnetic elements 78*a*, 122*b* can be arranged such that the magnetic elements 78*a*, 122*b* resist alignment. In other words, magnetic element 78*a* can exert a magnetic pushing force on magnetic element 122*b*, for example. As the yoke 108 pivots toward the counterclockwise second position, the magnetic element 78*b* can move toward alignment with the magnetic element 122*a*. In various embodiments, the poles of magnetic elements 78*b*, 122*a* can be arranged such that the magnetic elements 78*b*, 122*a* resist alignment. In other words, the magnetic element 78*b* can exert a magnetic pushing force on magnetic element 122*a*, for example. In at least one embodiment, when the yoke 108 is in the first position relative to the arm 60*a*, the positive pole of the magnetic element 78*a* can correspond to the negative pole of the magnetic element 122*a*, for example, and the negative pole of the magnetic element 78*b* can correspond to the positive pole of the magnetic element 122*b*, for example. The reader will understand that the magnetic pivot arrangement 70 can include additional or fewer magnetic elements, that alternative arrangements of the magnetic elements are possible, and that such arrangements are within the scope of this disclosure.

In use, a user can adjust or manipulate the assembly 20 by pivoting the yoke 108 relative to the attached extension arm 60*a*. For example, the magnetic elements 78*a*, 78*b* in the first extension arm 60*a* can be pivoted out of alignment with the magnetic elements 122*a*, 122*b* of the yoke 108 when the user positions the assembly 20 relative to the user's head and/or neck. Once misaligned, the magnetic elements 78*a*, 78*b*, 122*a*, 122*b* of the magnetic pivot arrangement 70 can seek to realign. In various embodiments, the magnetic elements 78*a*, 78*b* can exert a magnetic pull on magnetic elements 122*a*, 122*c* to pivot or attempt to pivot the magnetic pivot arrangement 70 back into realignment. In certain embodiments, the magnetic pull or force generated by the magnetic elements 78*a*, 78*b*, 122*a*, 122*b* can hold the assembly 20 in position relative to a user's head or neck. For example, the magnetic elements 78*a*, 78*b*, 122*a*, 122*b* can exert a force that comfortably secures the earphone assembly without apply an excessive force to the user's head and/or neck. Further, when the assembly 20 is removed from the user's head or neck and/or when the user stops actively adjusting the assembly 20, the magnetic pivot mechanism 70 can pivot the yoke 108 relative to the first extension arm 60*a* such that the magnetic pivot arrangement 70 returns to alignment and the assembly 20 returns to its initial configuration. In other words, the yoke can pivot back to the neutral position.

Figure 32:
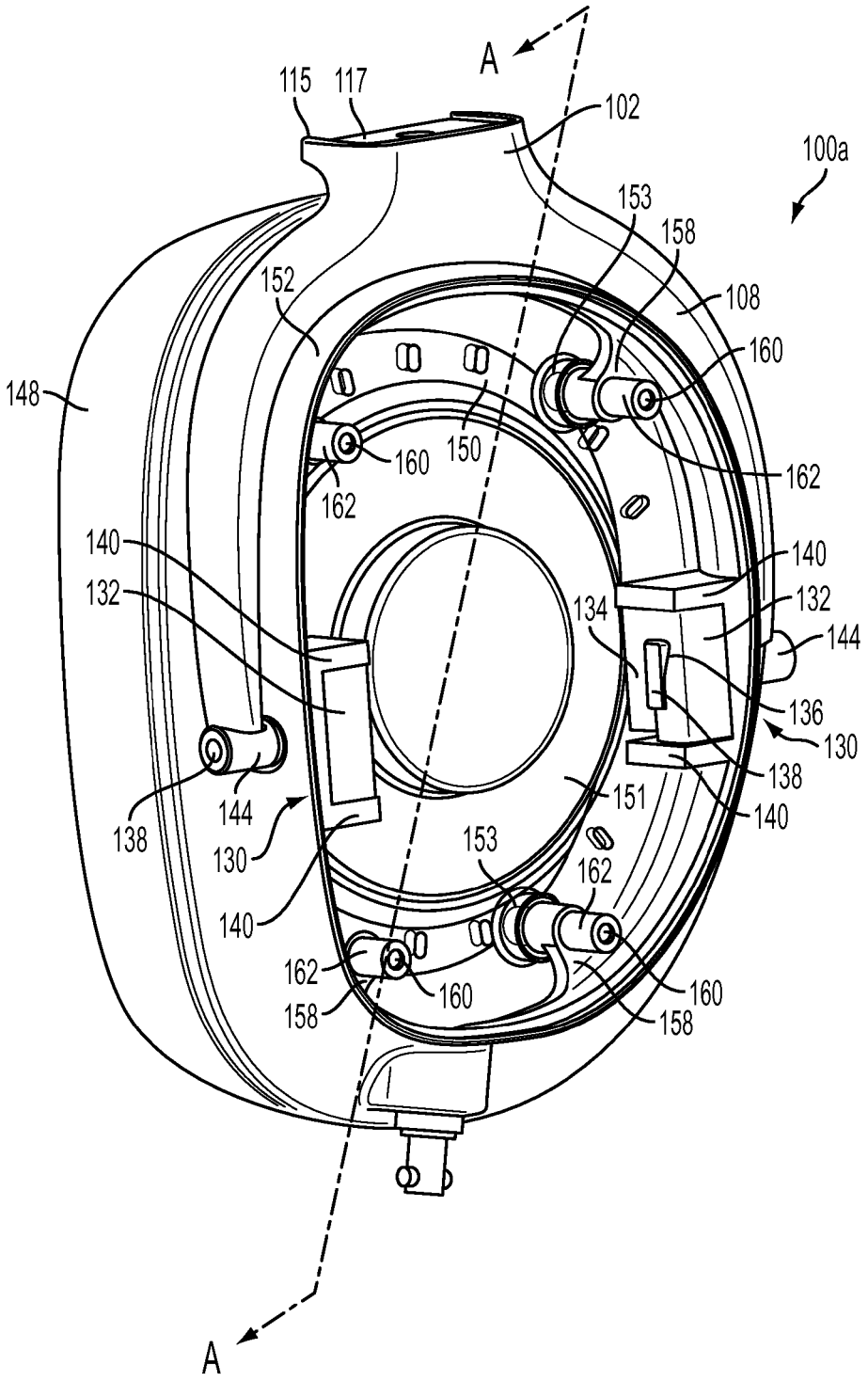
FIG. 32 is a perspective view of the personal speaker of FIG. 30 with an outer housing removed therefrom according to various embodiments of the present disclosure.

Referring primarily to FIGS. 30-34, the first earphone 100*a* can include the housing pivot arrangement 130, which can permit the housing ring 152 to pivot relative to the yoke 108. For example, the housing ring 152 can be pivotally secured to the yoke 108 at a housing pivot arrangement 130. In certain embodiments, the housing ring 152 can be pivotally secured to the yoke 108 at two opposing housing pivot arrangements 130. As described herein, the housing ring 152 can be secured to the yoke 108 by the housing pivot arrangement 130, which can permit the housing ring 152 to pivot relative to the yoke 108, for example. In various embodiments, the housing ring 152 can support the speaker mount 150 (FIG. 32), an outer housing 154 (FIG. 31), and/or an ear cushion 148 (FIG. 30) of the first earphone 100*a*, for example. The housing ring 152 can form a ring or partial ring that defines a perimeter of the earphone 100*a*, for example. Referring primarily to FIG. 32, the speaker mount 150 can be positioned between the outer housing 154 (FIG. 31) and the ear cushion 148, for example, such that the speaker mount 150 is secured within the first earphone 100*a*. In certain embodiments, the speaker element 151 can be secured to the speaker mount 150 within the first earphone 100*a*. In other words, various speaker elements can be positioned in the first earphone 100*a* and/or can be contained within and/or by the housing ring 152, for example.

Figure 33:
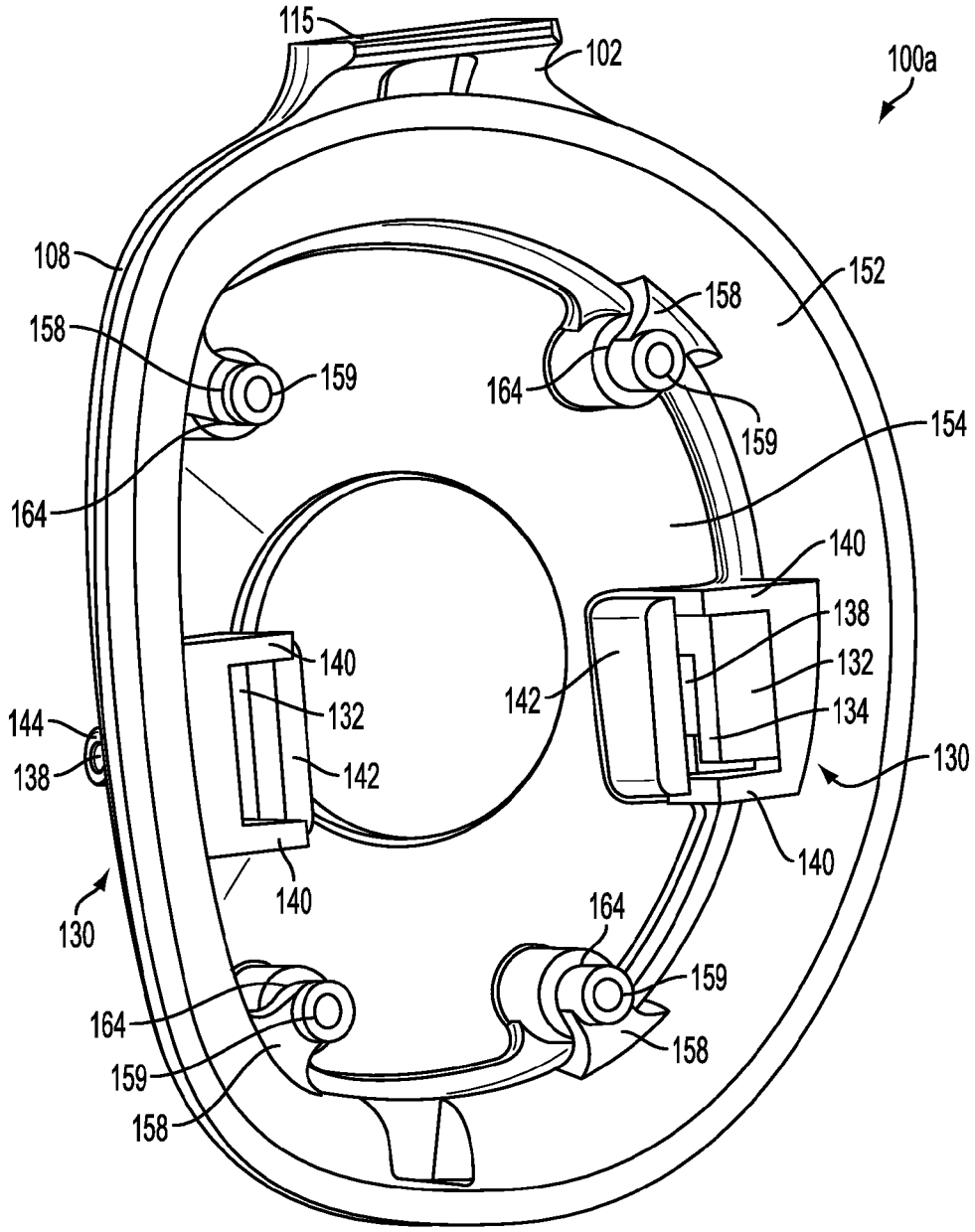
FIG. 33 is a perspective view of the personal speaker of FIG. 30 with an ear cushion, speaker mount, and speaker element removed therefrom according to various embodiments of the present disclosure.

Referring now to FIGS. 32 and 33, the housing ring 152 can include a plurality of flanges 158 with apertures 159 therethrough. In various embodiments, a fastener can engage the flanges 158 of the housing ring 152 to secure the housing ring 152 to the outer housing 154 and/or to the speaker mount 150. For example, a fastener, such as a bolt 160, can extend through an aperture 153 (FIG. 32) in the speaker mount 150, an aperture 159 (FIG. 33) in the flange 158 of the housing ring 152, and/or an aperture 164 (FIG. 33) in the outer housing 154, for example. The flanges 158 can be positioned around an inner perimeter of the housing ring 152, for example. In various embodiments, four flanges 158 can be spaced around the inner perimeter of the housing ring 152. In certain embodiments, less than or more than four flanges 158 can be spaced around the inner perimeter of the housing ring 152, such that the outer housing 154, speaker mount 150 and/or ear cushion 148 are sufficiently secured to the housing ring 152.

Figure 34:
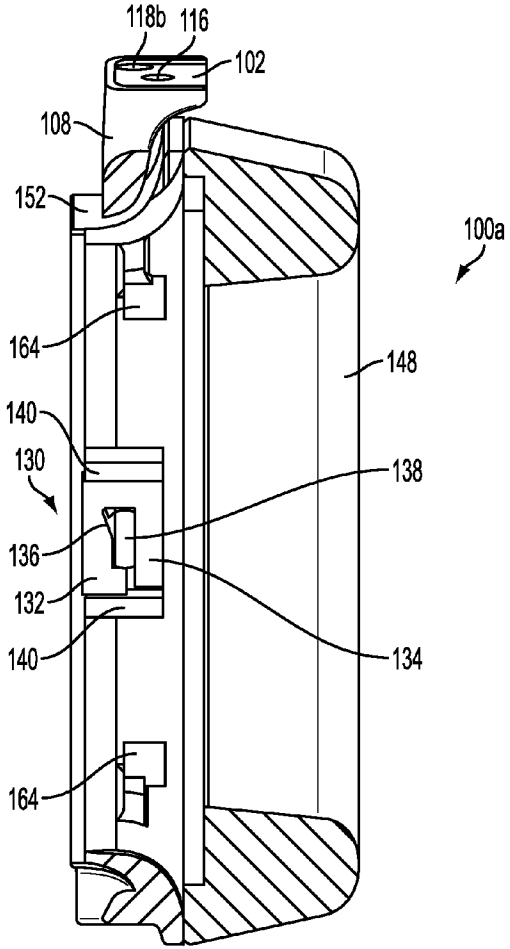
FIG. 34 is an elevational cross-sectional view of the personal speaker of FIG. 30 taken along the plane indicated in FIG. 32 according to various embodiments of the present disclosure.

Referring primarily to FIGS. 32-34, a portion of the housing ring 152 can hold a collar 132 of the housing pivot arrangement 130. For example, the housing ring 152 can include a shelf 140, which can be configured to hold or retain the collar 132. In certain embodiments, the housing ring 152 can house or retain opposing collars 132 therein. In various embodiments, shelves 140 can be positioned on multiple sides of the collar 132 to hold the opposing collars 132 therebetween. Furthermore, the speaker mount 150 can be positioned on another side of the collar (FIG. 32), and/or the outer housing 154 can be positioned on still another side of the collar (FIG. 33). In certain embodiments, a portion of the outer housing 154, such as extension 142, for example, can be positioned on still another side of the collar. In various embodiments, when multiple components of the earphone 100*a* are assembled, the multiple components can be configured to hold the collar 132 in position relative to the housing ring 152. For example, the shelf 140, a portion of the speaker mount 150, a portion of the outer housing, and/or the extension 142 can at least partially surround the collar 132 such that the collar 132 is fixed in position relative to the housing ring 152, for example. In other words, in various embodiments, the collar 132 can be immovably or non-pivotally secured to the housing ring 152. The reader will understand that various different and/or additional components can help to retain the collar 132 relative to the housing ring 152.

Figure 35:
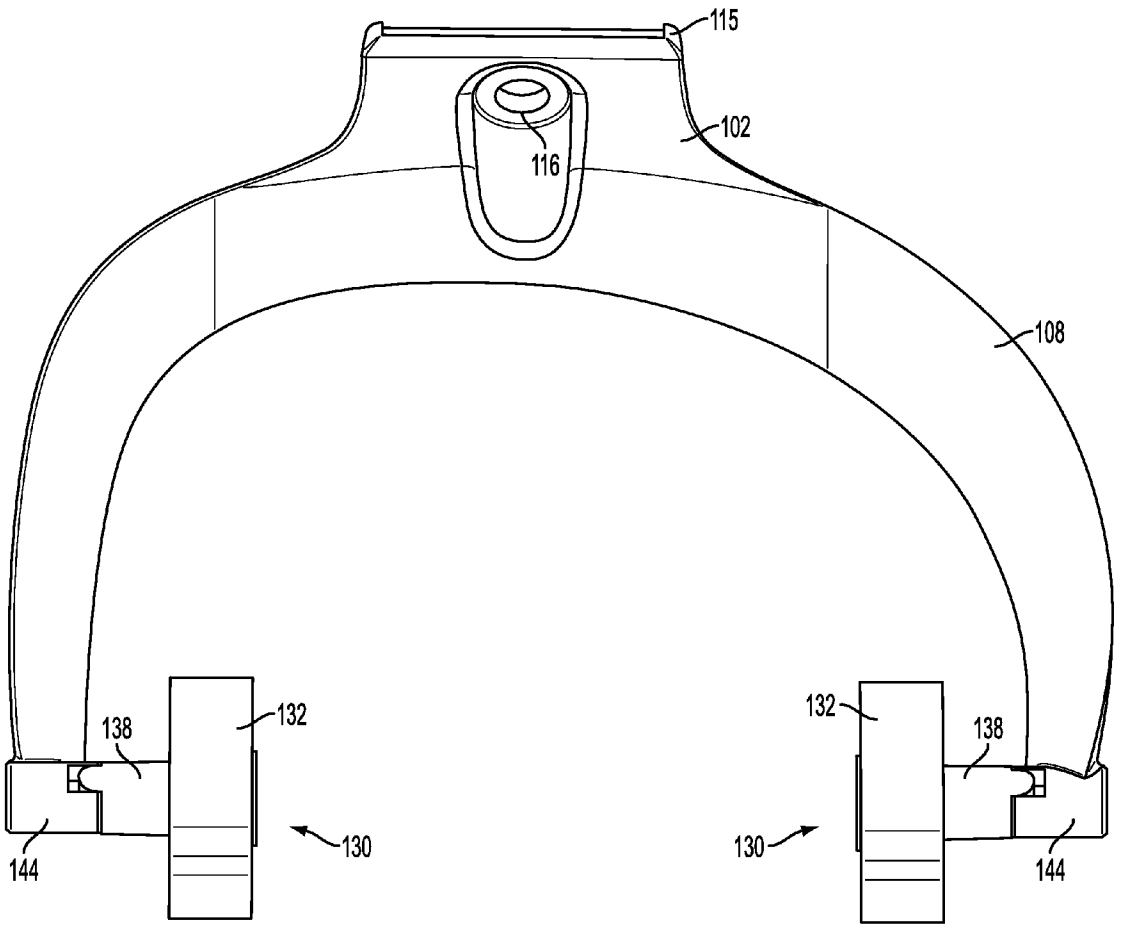
FIG. 35 is perspective view of the yoke of the personal speaker of FIG. 30 with a pivot pin and a collar of the yoke pivot arrangement attached thereto according to various embodiments of the present disclosure.

Referring primarily to FIG. 35, the pivot pin 138 of the housing pivot arrangement 130 can engage the yoke 108. In various embodiments, the yoke can have a hub 144, and a portion of the pivot pin 138 can extend into an aperture 143 (FIG. 24) in the hub 144. In various embodiments, the yoke 108 can have two hubs 144 on opposing sides of the yoke 108, for example, and a pivot pin 138 can be secured to each hub 144. The pivot pin 138 can be fastened or secured to the hub 144, for example, or can be integrally formed with the hub 144, for example. In various embodiments, the pivot pin 138 can be fixedly or non-pivotally connected to the hub 144 of the yoke 108. Referring again to FIGS. 30-34, the yoke 108 can extend at least partially around the housing ring 152, such that the hubs 144 of the yoke 108 are positioned on opposite sides of the housing ring 152, for example. Further, the pivot pins 138, which extend from the hubs 144, can each extend through an aperture 145 (FIG. 31) in the housing ring 152 and into the collar 132 that is secured therein. In various embodiments, the housing ring 152 can be pivotally connected to the yoke 108 by the housing pivot arrangement 130, which includes the collar 132 and the pivot pin 138. For example, the pivot pin 138 extending from the housing ring 152 can pivot within the aperture 145 of the housing ring 152 and in the collar 132. In certain embodiments, the housing ring 152 can be pivotally connected to the yoke 108 at opposing housing pivot arrangement 130 positioned on opposite sides of the housing ring 152. In other words, the housing ring 152 can pivot relative to the yoke 108 at opposing housing pivot arrangements 130. The collar 132 can be fixed relative to the housing ring 152, such that pivoting of the pivot pin 138 causes the yoke 108 to pivot in the collar 132 and relative to the housing ring 152. As described herein, the collar 132 can control the rotational direction and/or the range of rotation of the pivot pin 138 and the yoke 108 relative to the housing ring 152, for example.

Figure 36:
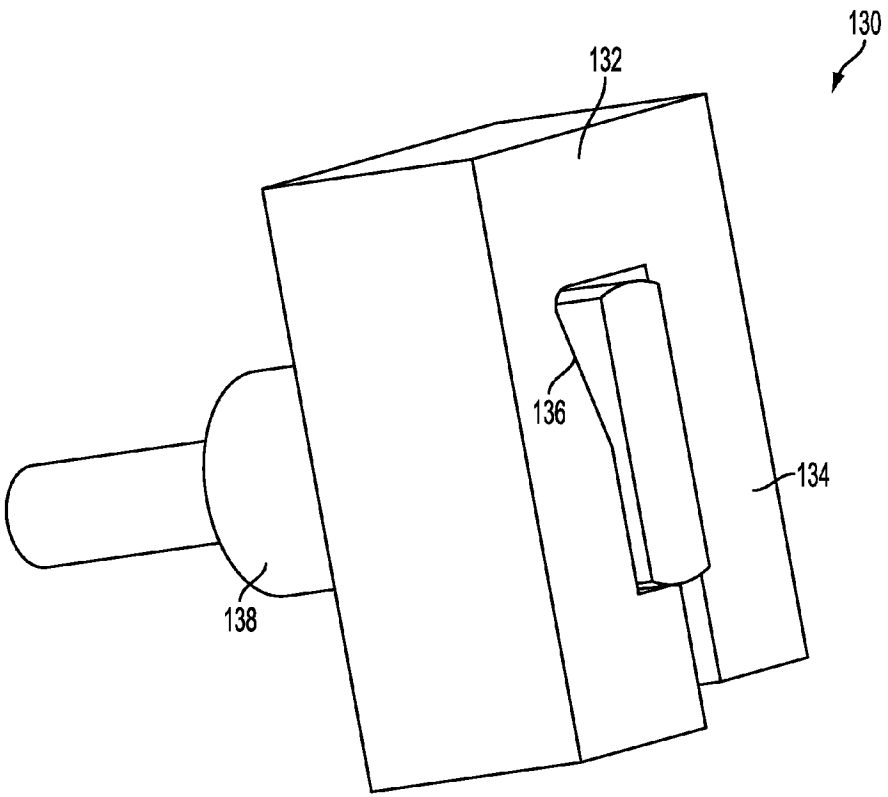
FIG. 36 is a perspective view of the pivot pin and the collar of the yoke pivot arrangement of FIG. 35 according to various embodiments of the present disclosure.
Figure 37:
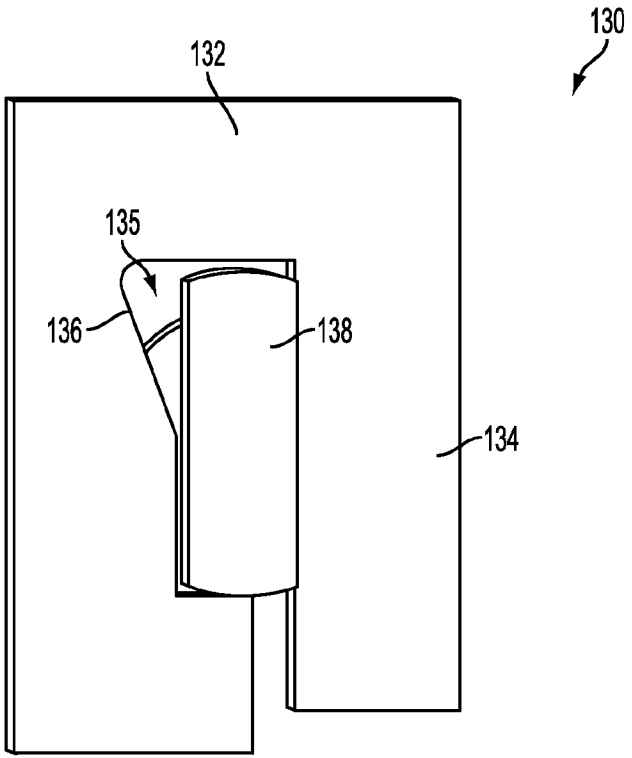
FIG. 37 is an elevational view of the pivot pin and the collar of the yoke pivot arrangement of FIG. 36 according to various embodiments of the present disclosure.

In various embodiments, referring primarily to FIG. 36-38, the collar 132 can include an opening or space 135, an arm 134, and/or a wedge stop 136. The arm 134 can define a first side or surface of the opening 135, for example, and/or the wedge stop 136 can define a second side or surface of the opening 135, for example. In various embodiments, the wedge stop 136 surface can be angularly oriented relative to the arm 134 surface, for example. In certain embodiments, as described herein, the pivot pin 138 can be received in the opening 135 of the collar 136. For example, the pivot pin 138 can extend from the hub 144 of the yoke 108 (FIG. 35) and to between the arm 134 and the wedge stop 136 of the collar 132. The arm 134 and the wedge stop 136 can control the pivoting movement of the pivot pin 138 in the opening 135. For example, the pivot pin 138 can pivot counterclockwise from the vertical configuration (FIG. 37) until the pivot pin 138 reaches the wedge stop 136. In various embodiments, as the pivot pin 138 pivots towards the wedge stop 136, the arm 134 can flex, move outward or deform to accommodate the pivot pin 138. Further, when the pivot pin 138 abuts the wedge stop 136 further rotation of the pivot pin 138 can be prevented by the wedge stop 136. Referring still to FIGS. 37-39, clockwise rotation of the pivot pin from the vertical configuration (FIG. 38) can be prevented by the flexible arm 134 and the non-wedged portion of the collar 132. In alternative embodiments, the opening 135 in the collar 132 can permit approximately 20 degrees of rotation, for example. In other embodiments, the opening 135 can permit less than or more than 20 degrees of rotation, for example. Further, in various embodiments, the opening 135 can be configured to permit clockwise rotation and prevent counterclockwise rotation, for example.

In various embodiments, the collar 132 can be more flexible than the pivot pin 138 such that the arm 134 of the collar 132 substantially flexes or deforms and the pivot pin 138 substantially maintains its shape when the pivot pin 138 pivots into and/or against the arm 134. For example, the collar 132 can comprise a sufficiently resilient material, such that the flexible 134 can flex or deform to accommodate the pivot pin 138, and can subsequently return or substantially return to its undeformed position when the pivot pin returns to its initial, non-pivoted configuration. In certain embodiments, the collar 132 can comprise an elastomeric material such as urethane, for example. Further, in certain embodiments, the pivot pin 138 can comprise a substantially rigid material such as brass, for example.

Referring again to FIGS. 32 and 33, in use, the pivot pin 138 can pivot or turn in the collar 130 to adjust the position of the yoke 108 relative to the housing ring 152. For example, the pivot pin 138 can pivot away from the arm 134 toward the wedge stop 136 when the user positions the assembly 20 relative to the user's head and/or neck. When the pivot pin 138 pivots toward the wedge stop 136, the pivot pin 138 can exert a force on the arm 134 such that the arm 134 deforms or flexes to accommodate the pivot pin 138. In various embodiments, the arm 134 can exert a springback force on the pivot pin 138, which can help to maintain the relative positions of the yoke 108 and the housing ring 152, for example. Furthermore, the relative positions of the yoke 108 and the housing ring 152 can help to hold the assembly 20 in position relative to a user's head or neck. For example, the ring housing 152 can be pivoted toward a user's ear, such that the ear cushion 148 of the earpiece 100*a* exerts a force on the user's ear that comfortably secures the assembly 20 relative to the user's head and/or neck without applying an excessive force thereto. Further, when the assembly 20 is removed from the user's head or neck and/or when the user stops actively adjusting the assembly 20, the arm 134 of the collar 132 can exert a force on the pivot pin 138 that causes the pivot pin 138 to pivot away from the wedge stop 136 and toward the arm 134 such that the housing pivot mechanism 130 pivots the ring housing 152 relative to the yoke 108 and the assembly 20 returns to its initial configuration.

In various embodiments, each earphone 100*a*, 100*b* can include an electrical conduit or wire (not shown) for transmitting audio signals from the audio source. The wire can connect to a receiver or jack 166 (FIG. 31) of the earphone 100*a*, 100*b*, for example. Alternatively or additionally, the earphones 100*a*, 100*b* can include a wireless transmission assembly. In such a wireless assembly, the earpieces may not be physically coupled to the audio source, but can include a battery pack (not shown) and a transceiver (not shown) for wirelessly receiving the audio signal. In various embodiments, one of the earphones 100*a*, 100*b* can be coupled to a wire for receiving audio signals, and the other earphone 100*a*, 100*b* can be wirelessly coupled to the wired earphone 100*a*, 100*b*. In various wired embodiments, the headband assembly 22 can include an electrical conduit or wire (not shown) that passes through the headband assembly 22 from the first earphone 100*a* to the second earphone 100*b*. For example, a wire can run from the first earphone 100*a*, along the first arm 60*a*, the first sleeve 40*a*, the spring band 30, the second sleeve 40*b*, and the second arm 60*b*, to the second earphone 100*b*, for example. The wire can be embedded in the headband assembly 22 and/or covered by the frame 92, cover 94 and/or foam 98, for example.

At least one embodiment of the present disclosure relates to a headband assembly for holding a personal speaker relative to a user's ear, wherein the headband assembly comprises a spring band, a sleeve in which is disposed a first end portion of the spring band, and an arm. In such embodiments, the sleeve comprises a first plurality of detent pockets and a second plurality of detent pockets positioned laterally relative to the first plurality of detent pockets. Furthermore, the arm comprises a first spring-loaded bearing that adjustably engages one pocket of the first plurality of detent pockets and a second spring-loaded bearing that adjustably engages one pocket of the second plurality of detent pockets. Additionally, the first and second spring-loaded bearings adjustably secure the arm to the sleeve when the first spring-loaded bearing engages one pocket of the first plurality of detent pockets and the second spring-loaded bearing engages one pocket of the second plurality of detent pockets.

In some of these embodiments, the headband assembly further comprises a second sleeve in which is disposed a second end portion of the spring band, and a second arm. In such embodiments, the second sleeve comprises a first plurality of detent pockets and a second plurality of detent pockets positioned laterally relative to the first plurality of detent pockets. Furthermore, the second arm comprises a first spring-loaded bearing that adjustably engages one pocket of the first plurality of detent pockets of the second sleeve and a second spring-loaded bearing that adjustably engages one pocket of the second plurality of detent pockets of the second sleeve. Additionally, the first and second spring-loaded bearings of the second arm adjustably secure the second arm to the second sleeve when the first spring-loaded bearing engages one pocket of the first plurality of detent pockets of the second sleeve and the second spring-loaded bearing engages one pocket of the second plurality of detent pockets of the second sleeve. In some of these embodiments, the headband assembly further comprises a first personal speaker attached to the arm, and a second personal speaker attached to the second arm.

In some embodiments, the spring band comprises a pronged portion at the first end portion and laterally opposed tabs that maintain connection between the sleeve and the pronged portion received therein. Furthermore, the pronged portion exerts a springback force on the sleeve when the pronged portion is disposed in the sleeve. In some of these embodiments, the spring band and the sleeve form a snap-fit connection. In some embodiments, the headband assembly comprises a cap attached to the sleeve and at least partially surrounding the arm, wherein the cap guides the arm relative to the sleeve. In some of these embodiments, the arm comprises a slot that receives a portion of the cap, and the portion of the cap is slidable within the slot as the arm moves relative to the sleeve. In some of these embodiments, the cap comprises an extension stop that operably engages an end of the slot to limit movement of the arm away from the spring band.

In some embodiments, the sleeve comprises a retraction stop that operably engages an end of the arm to limit movement of the arm toward the spring band. In some embodiments, the headband assembly comprises a liner positionable relative to the sleeve such that the liner and the sleeve at least partially surround a portion of the arm. In some embodiments, the headband assembly comprises at least one aesthetic component. In some of these embodiments, at least one aesthetic component is selected from a group comprising a frame, a cushion, a cover, and an indicia.

At least one embodiment of the present disclosure relates to a headband assembly comprising a band, a first sleeve attached to an end portion of the band, and a first extension moveably secured to the first sleeve. Furthermore, the first sleeve comprises a pair of laterally opposed detent channels. Additionally, the first extension comprises a pair of spring-loaded bearings, and each spring-loaded bearing engages one of the pair of laterally opposed detent channels.

In some of these embodiments, the headband assembly comprises a personal speaker secured to the first arm. In some embodiments, the headband assembly comprises a cap removably attached to the first sleeve and positioned around a portion of the first arm, wherein the cap guides the first arm relative to the first sleeve. In some embodiments, the headband assembly comprises a second sleeve attached to another end of the band, and a second extension moveably secured to the second sleeve. In such embodiments, the second sleeve comprises a second pair of laterally opposed detent channels, and the second extension comprises a second pair of spring-loaded bearings, wherein each spring-loaded bearing of the second extension engages one of the second pair of laterally opposed detent channels of the second sleeve.

At least one embodiment of the present disclosure relates to an assembly comprising an extension arm, an attachment element, and a spring member secured to the attachment element. In such embodiments, the extension arm comprises a first detent bearing and a second detent bearing. Furthermore, in such embodiments, the attachment element comprises a first row of detent pockets that receives the first detent bearing, and a second row of detent pockets that receives the second detent bearing, wherein the first row of detent pockets laterally opposes the second row of detent pockets, and wherein the extension arm is moveably positioned relative to the attachment element.

In some of these embodiments, the assembly comprises a second extension arm and a second attachment element. In such embodiments, the second extension arm comprises a first detent bearing and a second detent bearing. Additionally, in such embodiments, the spring member is secured to the second attachment member, which comprises a first row of detent pockets that receives the first detent bearing of the second extension arm, and a second row of detent pockets that receives the second detent bearing of the second extension arm, wherein the first row of detent pockets laterally opposes the second row of detent pockets, and wherein the second extension arm is moveably positionable relative to the second attachment element.

In some of these embodiments, the assembly comprises a plurality of personal speakers. In some embodiments, the assembly comprises a first cap and a second cap. Furthermore, the first cap is attached to the first attachment portion and positioned around a portion of the first extension arm, wherein the first cap guides the first extension relative to the first attachment element. Additionally, in such embodiments, the second cap is removably attached to the second attachment portion and positioned around a portion of the second extension arm, wherein the second cap guides the second extension relative to the second attachment element.

At least one embodiment of the present disclosure relates to a headband assembly for holding a personal speaker relative to a user's ears. The headband assembly comprises a band and a yoke configured to support the personal speaker. The band comprises a band body, a groove, and a first band magnetic element. The band body comprises a first surface, and the groove extends from the first surface into the band body. The yoke comprises a yoke body, a protrusion, and a first yoke magnetic element. The yoke body comprises a second surface, wherein the second surface is positioned relative to the first surface, and the protrusion extends from the second surface into the groove of the band. The yoke is configured to pivot between a first position and at least one second position relative to the band, wherein a magnetic pole of the first band magnetic element is aligned with a magnetic pole of the first yoke magnetic element when the yoke is in a first position, and wherein a magnetic attraction between the first band magnetic element and the first yoke magnetic element pulls the magnetic poles of the first yoke magnetic element and the first band magnetic element toward aligned when the yoke is in the second position.

In some of these embodiments, the band comprises a second band magnetic element, the yoke comprises a second yoke magnetic element, and a pole of the second band magnetic element is aligned with a pole of the second yoke magnetic element when the yoke is in the first position, and a magnetic attraction between the second band magnetic element and the second yoke magnetic element pulls the magnetic poles of the second yoke magnetic element and the second band magnetic element toward alignment when the yoke is in the second position. In some of these embodiments, the first yoke magnetic element resists alignment with the second band magnetic element, and the second yoke magnetic element resists alignment with the first band magnetic element. In some embodiments, the first and second band magnetic elements are recessed in the band to at least flush with the first surface, and the first and second yoke magnetic elements are recessed in the yoke to at least flush with the second surface.

In some of these embodiments, the groove defines a contour having a first radius of curvature, the protrusion defines a contour having a second radius of curvature, and the second radius of curvature substantially matches the first radius of curvature. In some embodiments, the groove defines a first rotational stop, and the yoke is configured to pivot in a first direction relative to the band until the protrusion abuts the first rotational stop. In some of these embodiments, the groove defines a second rotational stop, and the yoke is configured to pivot in a second direction relative to the band until the protrusion abuts the second rotational stop, wherein the second direction is opposite to the first direction.

In some of these embodiments, the head band assembly comprises a pin configured to hold the second surface of the yoke relative to the first surface of the band. In some of these embodiments, the pin extends from the band and pivotally engages an aperture in the yoke. In some of these embodiments, a retainer secures the pin within the aperture. In some embodiments, the headband assembly comprises a pivot plate secured to the yoke, wherein the pivot plate comprises the protrusion, and wherein the pivot plate is positioned between the first band magnetic element and the second band magnetic element.

At least one embodiment of the present disclosure relates to a headband assembly comprising a band, and a yoke configured to pivot between a neutral position and pivoted positions. The band comprises a band body, a groove, and a first pair of magnetic elements. The band body comprises a first surface, and the groove extends from the first surface into the band body. The yoke comprises a yoke body, a protrusion, and a second pair of magnetic elements. The yoke body comprises a second surface, and the protrusion extends from the second surface into the groove of the band. The yoke is configured to pivot between a neutral position and pivoted positions relative to the band, the first and second pairs of magnetic elements interact to generate a magnetic force, and the magnetic force forces the yoke toward the neutral position when the yoke is in one of the pivoted positions.

In some of these embodiments, the magnetic force comprises a pulling force that seeks to pull the yoke from a pivoted position to the neutral position. In some embodiments, the magnetic force comprises a pushing force that resists movement of the yoke from the neutral position to one of the pivoted positions. In some embodiments, the groove is positioned substantially between the magnetic elements of the first pair of magnetic elements, and the protrusion is positioned substantially between the magnetic elements of the second pair of magnetic elements.

In some of these embodiments, the first pair of magnetic elements are embedded in the band, and the second pair of magnetic elements are embedded in the yoke. In some embodiments, the groove is defined by a first and second stop, and the yoke is configured to pivot in a first direction until the protrusion abuts the first stop and in a second direction until the protrusion abuts the second stop. In some embodiments, the headband assembly comprises a pivot plate positioned between the first surface of the band and the second surface of the yoke. In some of these embodiments, the pivot plate extends between the first pair of magnetic elements and the second pair of magnetic elements. In some embodiments, the headband assembly comprises a plurality of personal speakers.

At least one embodiment of the present disclosure relates to an earpiece for holding a personal speaker, wherein the earpiece comprises a housing configured to hold the personal speaker, and a yoke pivotally secured to the housing. The housing comprises a collar comprising an arm comprising an arm surface, a stop comprising a stop surface, and an opening between the arm surface and the stop surface. The stop surface is angularly oriented relative to the arm surface. The yoke comprises a pin configured to engage the housing, wherein the pin comprises a head, wherein the head is configured to extend into the opening in the collar, and wherein the head is configured to pivot between the arm surface and the stop surface.

In some of these embodiments, the collar comprises an elastomeric material. In some embodiments, the collar comprises a retainer configured to hold the collar in the housing. In some of these embodiments, the retainer comprises a plurality of walls around the collar. In some of these embodiments, the housing comprising an outer housing, and the plurality of walls comprises an extension that extends from the outer housing. In some embodiments, the plurality of walls comprises a speaker mount positioned in the housing. In some embodiments, the plurality of walls comprises a shelf that extends from the housing.

In some of these embodiments, the arm is configured to deform as the pin pivots from the arm surface toward the stop surface, and the arm seeks to return to its undeformed configuration. In some embodiments, the housing comprises a second collar that comprises an arm comprising an arm surface, a stop comprising a stop surface, and an opening between the arm surface and stop surface. The stop surface is angularly oriented relative to the arm surface. The yoke comprises a second pin configured to engage the housing, wherein the second pin comprises a head, wherein the head is configured to extend into the opening in the second collar, and wherein the head is configured to pivot between the arm surface and the stop surface of the second collar. In some of these embodiments, the pin extends toward the collar in a first direction, wherein the second pin extends toward the second collar in a second direction, and wherein the second direction is substantially opposite to the first direction. In some embodiments, the collar is positioned on a first side of the housing, wherein the second collar is positioned on a second side of the housing, and wherein the first side is substantially opposite to the second side.

At least one embodiment of the present disclosure relates to an earpiece assembly comprising a housing configured to hold a personal speaker, a collar fixed to the housing, a yoke, wherein the housing is configured to pivot relative to the yoke, and a pin fixed to the yoke. The collar comprises a flexible arm comprising an arm surface and a stop comprising a stop surface, wherein the stop surface is angularly oriented relative to the arm surface. The pin extends from the yoke to between the flexible arm and the stop of the collar, and the pin is configured to deform the flexible arm as the pin pivots from the arm surface toward the stop surface of the collar.

In some of these embodiments, the pin is configured to pivot from the arm surface to the stop surface, and the stop surface limits further pivoting of the pin. In some embodiments, the collar comprises an elastomeric material. In some of these embodiments, the pin is substantially rigid. In some embodiments, the earpiece assembly comprises a second collar fixed to the housing and a second pin fixed to the yoke. The second collar comprises a flexible arm comprising an arm surface, and a stop comprising a stop surface, wherein the stop surface is angularly oriented relative to the arm surface. The second pin extends from the yoke to between the flexible arm and the stop of the second collar, and the second pin is configured to deform the flexible arm of the second collar as the second pin pivots from the arm surface toward the stop surface of the second collar. In some of these embodiments, the yoke is pivotally fastened to the housing at the pin and the second pin. In some embodiments, the pin extends from the yoke in a first direction, the second pin extends from the yoke in a second direction, and the second direction is substantially opposite to the first direction. In some embodiments, the collar is laterally opposed to the second collar. In some embodiments, the earpiece assembly comprises a personal speaker.

Various embodiments of the present invention are described and illustrated in this specification to provide an overall understanding of the steps and uses of the disclosed devices and methods. It is understood that the various embodiments described and illustrated in this specification are non-limiting and non-exhaustive. Thus, the invention is not limited by the description of the various non-limiting and non-exhaustive embodiments disclosed in this specification. In appropriate circumstances, the features and characteristics described in connection with various embodiments may be combined with the features and characteristics of other embodiments. Such modifications and variations are intended to be included within the scope of this specification. As such, the claims may be amended to recite any steps, limitations, features, and/or characteristics expressly or inherently described in, or otherwise expressly or inherently supported by, this specification. Further, Applicant(s) reserves the right to amend the claims to affirmatively disclaim steps, limitations, features, and/or characteristics that are present in the prior art regardless of whether such features are explicitly described herein. Therefore, any such amendments comply with the requirements of 35 U.S.C. §112, first paragraph, and 35 U.S.C. §132(a). The various embodiments disclosed and described in this specification can comprise, consist of, or consist essentially of the steps, limitations, features, and/or characteristics as variously described herein.

The grammatical articles "one", "a", "an", and "the", if and as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise.

The invention claimed is:

1. A headband assembly for holding a personal speaker relative to a user's ear, wherein the headband assembly comprises:

a band, comprising:
- a band body, comprising a first surface;
- a groove extending from the first surface into the band body; and
- a first band magnetic element; and a yoke configured to support the personal speaker, wherein the yoke comprises:
- a yoke body, comprising a second surface, wherein the second surface is positioned relative to the first surface;
- a protrusion extending from the second surface into the groove of the band; and
- a first yoke magnetic element;

wherein the yoke is configured to pivot between a first position and at least one second position relative to the band, wherein a magnetic pole of the first band magnetic element is aligned with a magnetic pole of the first yoke magnetic element when the yoke is in the first position, and wherein a magnetic attraction between the first band magnetic element and the first yoke magnetic element pulls the magnetic poles of the first yoke magnetic element and the first band magnetic element toward alignment when the yoke is in the second position.

2. The headband assembly of claim 1, wherein the band comprises a second band magnetic element, wherein the yoke comprises a second yoke magnetic element, and wherein a pole of the second band magnetic element is aligned with a pole of the second yoke magnetic element when the yoke is in the first position, and wherein a magnetic attraction between the second band magnetic element and the second yoke magnetic element pulls the magnetic poles of the second yoke magnetic element and the second band magnetic element toward alignment when the yoke is in the second position.

3. The headband assembly of claim 2, wherein the first yoke magnetic element resists alignment with the second band magnetic element, and wherein the second yoke magnetic element resists alignment with the first band magnetic element.

4. The headband assembly of claim 2, wherein the first and second band magnetic elements are recessed in the band to at least flush with the first surface, and wherein the first and second yoke magnetic elements are recessed in the yoke to at least flush with the second surface.

5. The headband assembly of claim 1, wherein the groove defines a contour having a first radius of curvature, wherein the protrusion defines a contour having a second radius of curvature, and wherein the second radius of curvature substantially matches the first radius of curvature.

6. The headband assembly of claim 1, wherein the groove defines a first rotational stop, and wherein the yoke is configured to pivot in a first direction relative to the band until the protrusion abuts the first rotational stop.

7. The headband assembly of claim 6, wherein the groove defines a second rotational stop, wherein the yoke is configured to pivot in a second direction relative to the band until the protrusion abuts the second rotational stop, and wherein the second direction is opposite to the first direction.

8. The headband assembly of claim 1, comprising a pin configured to hold the second surface of the yoke relative to the first surface of the band.

9. The headband assembly of claim 8, wherein the pin extends from the band and pivotally engages an aperture in the yoke.

10. The headband assembly of claim 9, wherein a retainer secures the pin within the aperture.

11. The headband assembly of claim 1, comprising a pivot plate secured to the yoke, wherein the pivot plate comprises the protrusion, and wherein the pivot plate is positioned between the first band magnetic element and the second band magnetic element.

12. A headband assembly, comprising:

a band, comprising:

a band body, comprising a first surface;

a groove extending from the first surface into the band body; and a first pair of magnetic elements; and a yoke configured to support a personal speaker, wherein the yoke comprises:

a yoke body, comprising a second surface;

a protrusion extending from the second surface into the groove of the band; and a second pair of magnetic elements;

wherein the yoke is configured to pivot between a neutral position and pivoted positions relative to the band, wherein the first and second pairs of magnetic elements interact to generate a magnetic force, and wherein the magnetic force forces the yoke toward the neutral position when the yoke is in one of the pivoted positions.

13. The headband assembly of claim 12, wherein the magnetic force comprises a pulling force that seeks to pull the yoke from a pivoted position to the neutral position.

14. The headband assembly of claim 12, wherein the magnetic force comprises a pushing force that resists movement of the yoke from the neutral position to one of the pivoted positions.

15. The headband assembly of claim 12, wherein the groove is positioned substantially between the magnetic elements of the first pair of magnetic elements, and wherein the protrusion is positioned substantially between the magnetic elements of the second pair of magnetic elements.

16. The headband assembly of claim 12, wherein the first pair of magnetic elements are embedded in the band, and wherein the second pair of magnetic elements are embedded in the yoke.

17. The headband assembly of claim 12, wherein the groove is defined by a first and second stop, and wherein the yoke is configured to pivot in a first direction until the protrusion abuts the first stop and in a second direction until the protrusion abuts the second stop.

18. The headband assembly of claim 12, comprising a pivot plate positioned between the first surface of the band and the second surface of the yoke.

19. The headband assembly of claim 18, wherein the pivot plate extends between the first pair of magnetic elements and the second pair of magnetic elements.

20. The headband assembly of claim 12, comprising a plurality of personal speakers.

* * * * *